US005698498A

United States Patent [19]

Luciani et al.

[11] Patent Number: 5,698,498

[45] Date of Patent: Dec. 16, 1997

[54] HYDROXYALKYL DITHIOCARBAMATES, THEIR BORATED ESTERS AND LUBRICANTS, FUNCTIONAL FLUIDS, GREASES AND AQUEOUS COMPOSITIONS CONTAINING THE SAME

[75] Inventors: Carmen V. Luciani, Wickliffe; Syed Q. A. Rizvi, Mentor; Bernard C. Roell, Jr., Willoughby, all of Ohio

[73] Assignee: The Lubrizol Corporation, Wickliffe, Ohio

[21] Appl. No.: 702,194

[22] Filed: Aug. 23, 1996

Related U.S. Application Data

[63] Continuation of Ser. No. 521,098, Aug. 29, 1995, abandoned, which is a continuation of Ser. No. 83,422, Jun. 28, 1993, abandoned.

[51] Int. Cl.[6] ..... C10M 141/02; C10M 135/18

[52] U.S. Cl. ..... 508/193; 508/187; 508/193; 508/322; 508/368; 508/444

[58] Field of Search ..... 508/193, 187, 508/322, 368, 444

[56] References Cited

U.S. PATENT DOCUMENTS

| | | | |
|---|---|---|---|
| 3,197,405 | 7/1965 | Le Suer | 252/32.7 |
| 3,347,792 | 10/1967 | Le Suer | 252/74.5 |
| 3,407,222 | 10/1968 | Lies | 260/455 |
| 3,412,026 | 11/1968 | Booker | 252/47.5 |
| 3,484,429 | 12/1969 | Le Suer | 252/47.5 |
| 3,498,915 | 3/1970 | Coleman | 252/47.5 |
| 3,544,465 | 12/1970 | Brald | 252/46.6 |
| 3,849,320 | 11/1974 | Bridger et al. | 252/33.6 |
| 4,089,790 | 5/1978 | Adams | 252/18 |
| 4,119,549 | 10/1978 | Davis | 252/45 |
| 4,119,550 | 10/1978 | Davis et al. | 252/45 |
| 4,161,534 | 7/1979 | Schweizer | 424/300 |
| 4,191,659 | 3/1980 | Davis | 252/45 |
| 4,308,154 | 12/1981 | Clason et al. | 252/32.7 |
| 4,344,854 | 8/1982 | Davis et al. | 252/45 |
| 4,417,990 | 11/1983 | Clason et al. | 252/32.7 |
| 4,582,618 | 4/1986 | Davis | 252/32.7 |
| 4,584,115 | 4/1986 | Davis | 252/49.6 |
| 4,670,169 | 6/1987 | Adams et al. | 252/46.7 |
| 4,740,322 | 4/1988 | DiBiase et al. | 252/47.5 |
| 4,744,920 | 5/1988 | Fischer et al. | 252/33.4 |
| 4,770,807 | 9/1988 | Musikas et al. | 252/184 |
| 4,792,410 | 12/1988 | Schwind et al. | 252/30 |
| 4,876,374 | 10/1989 | Adams et al. | 558/109 |
| 4,997,969 | 3/1991 | Luciani | 252/47.5 |
| 5,126,063 | 6/1992 | Cardis et al. | 252/46.3 |
| 5,182,036 | 1/1993 | Okorodudu et al. | 252/49.6 |

*Primary Examiner*—Jacqueline V. Howard

*Attorney, Agent, or Firm*—Frederick D. Hunter; John H. Engelmann; William J. Connors

[57] ABSTRACT

This invention relates to a lubricating composition comprising a major amount of an oil of lubricating viscosity and (A) a minor amount of at least one hydroxyalkyl dithiocarbamate or at least one borate thereof, wherein the dithiocarbamate is derived from an amine other than an alkyl or alkenylsuccinimide. In another aspect the invention relates to a lubricating composition comprising a major amount of an oil of lubricating viscosity, a hydroxyalkyl dithiocarbamate or a borate thereof, and (B) at least one sulfur compound or (C) at least one phosphorus or boron antiwear or extreme pressure agent. The invention also relates to greases, functional fluids and aqueous fluids containing the hydroxyalkyl dithiocarbamates and borates thereof. The lubricants and fluids have improved antiwear and extreme pressure properties including providing improved antiscuff protection.

32 Claims, No Drawings

HYDROXYALKYL DITHIOCARBAMATES, THEIR BORATED ESTERS AND LUBRICANTS, FUNCTIONAL FLUIDS, GREASES AND AQUEOUS COMPOSITIONS CONTAINING THE SAME

This is a continuation of application Ser. No. 08/521,098 filed on Aug. 29, 1995, now abandoned, which is a continuation of Ser. No. 08/083,422 filed on Jun. 28, 1993, now abandoned.

FIELD OF THE INVENTION

This invention relates to hydroxyalkyl dithiocarbamates. The hydroxyalkyl dithiocarbamates may be reacted with a boron compound to form borated esters. The hydroxyalkyl dithiocarbamates and their borated esters are useful in lubricants, functional fluids, greases, and aqueous compositions.

BACKGROUND OF THE INVENTION

Lubricating compositions, greases, and aqueous fluids are used to maintain a film of lubricant between surfaces which are moving with respect to each other. The compositions minimize contact of the moving surfaces thus preventing harmful wear to the surfaces. The compositions generally also lower the coefficient of friction. To be effective, the compositions should have sufficient antiwear, antiweld, and extreme pressure properties to minimize metal damage from metal-to-metal contact under high load conditions.

Polysulfides have been used to provide extreme pressure protection to lubricating compositions. High levels of polysulfides generally lead to higher extreme pressure protection. However, high levels of polysulfides can lead to copper corrosion, seal compatibility, oxidation stability, and thermal stability problems. It is beneficial to find a material that when combined with a polysulfide has good extreme pressure properties without the adverse effects caused by high levels of polysulfide.

U.S. Pat. No. 3,407,222, issued to Lies, relates to preparation of 2-hydroxyalkyldithiocarbamates from epoxides and amine salts of dithiocarbamic acid. The dithiocarbamates have herbicidal activity. U.S. Pat. No. 4,161,534, issued to Schweizer, relates to hydroxyalkyl dithiocarbamates. These compounds are useful as anthelmintic agents.

Sulfurized compositions prepared from unsaturated compounds and olefinic compounds have been described in U.S. Pat. No. 4,119,549 (Davis), U.S. Pat. No. 4,119,550 (Davis et al.), U.S. Pat. No. 4,191,659 (Davis), and U.S. Pat. No. 4,344,854 (Davis et al.).

SUMMARY OF THE INVENTION

This invention relates to a lubricating composition comprising a major amount of an oil of lubricating viscosity and (A) a minor amount of at least one hydroxyalkyl dithiocarbamate, or at least one borate thereof, wherein the dithiocarbamate is derived from an amine other than an alkyl or alkenylsuccinimide. In another aspect the invention relates to a lubricating composition comprising a major mount of an oil of lubricating viscosity, (A) a hydroxyalkyl dithiocarbamate or a borate thereof, and (B) at least one sulfur compound or (C) at least one phosphorus or boron antiwear or extreme pressure agent.

The invention alto relates to greases, functional fluids and aqueous fluids containing the hydroxyalkyl dithiocarbamates and borates thereof. Such lubricants and fluids have improved antiwear and extreme pressure properties including providing improved antiscuff protection.

DESCRIPTION OF THE PREFERRED EMBODIMENTS

The term "hydrocarbyl" includes hydrocarbon as well as substantially hydrocarbon groups. Substantially hydrocarbon describes groups which contain hetero atom substituents that do not alter the predominantly hydrocarbon nature of the substituent. Examples of hydrocarbyl groups include the following:

(1) hydrocarbon substituents, i.e., aliphatic (e.g., alkyl or alkenyl) and alicyclic (e.g., cycloalkyl, cycloalkenyl) substituents, aromatic-, aliphatic- and alicyclic-substituted aromatic substituents and the like as well as cyclic substituents wherein the ring is completed through another potion of the molecule (that is, for example, any two indicated substituents may together form an alicyclic radical);

(2) substituted hydrocarbon substituents, i.e., those substituents containing non-hydrocarbon groups which, in the context of this invention, do not alter the predominantly hydrocarbon nature of the substituent; those skilled in the art will be aware of such groups (e.g., halo (especially chloro and fluoro), hydroxy, mercapto, nitro, nitroso, sulfoxy, etc.);

(3) hetero atom substituents, i.e., substituents which will, while having a predominantly hydrocarbon character within the context of this invention, contain an atom other than carbon present in a ring or chain otherwise composed of carbon atoms (e.g., alkoxy or alkylthio). Suitable hetero atoms will be apparent to those of ordinary skill in the art and include, for example, sulfur, oxygen, nitrogen and such substituents as, e.g., pyridyl, furyl, thienyl, imidazolyl, etc.

In general, no more than about 2, preferably no more than one, hetero substituent will be present for every ten carbon atoms in the hydrocarbyl group. Typically, there will be no such hetero atom substituents in the hydrocarbyl group. Therefore, the hydrocarbyl group is purely hydrocarbon.

(A) Hydroxyalkyl Dithiocarbamates

The hydroxyalkyl dithiocarbamates may be prepared by reaction a dithiocarbamic acid or salt with an epoxide or by simultaneously reacting an amine, carbon disulfide and an epoxide. The dithiocarbamic acid or salt is prepared as is known to the art. The dithiocarbamic acids and salts are prepared by reacting carbon disulfide with an amine.

The amine may be a primary or a secondary, mono- or polyamine. The amines may be primary or secondary amines, with secondary amines most preferred. The amines generally may contain hydrocarbyl groups. Each hydrocarbyl group may independently contain from one up to about 40, preferably from about two up to about 30, more preferably from two up to about 24, or even up to about 12 carbon atoms. Here as well elsewhere in the specification, the ratio and range limits may be combined.

In one embodiment, the amines are primary amines. Examples of primary amines useful in the present invention include ethylamine, propylamine, butylamine, 2-ethylhexylamine, octylamine, and dodecylamine.

In one embodiment, the primary amine is a fatty ($C_{8-30}$) amine which include n-octylamine, n-decylamine, n-dodecylamine, n-tetradecylamine, n-hexadecylamine, n-octadecylamine, oleyamine, etc. Also useful fatty amines include commercially available fatty amines such as "Armeen" amines (products available from Akzo Chemicals, Chicago, Ill.), such as Akzo's Armeen C, Armeen O, Armeen OL, Armeen T, Armeen HT, Armeen S and Armeen SD, wherein the letter designation relates to the fatty group, such as cocoa, oleyl, tallow, or stearyl groups.

Other useful primary amines include primary ether amines, such as those represented by the formula, $R''(OR')_xNH_2$, wherein R' is a divalent alkylene group having about 2 to about 6 carbon atoms; x is a number from one to about 150, preferably from about one to about five, more preferably one; and R" is a hydrocarbyl group of about 5 to about 150 carbon atoms. An example of an ether amine is available under the name SURFAM® amines produced and marketed by Mars Chemical Company, Atlanta, Ga. Preferred etheramines are exemplified by those identified as SURFAM P14B (decyloxypropylamin), SURFAM P16A (linear $C_{16}$), SURFAM P17B (tridecyloxypropylamine). The carbon chain lengths (i.e., $C_{14}$, etc.) of the SURFAMS described above and used hereinafter are approximate and include the oxygen ether linkage.

In one embodiment, the amine is a tertiary-aliphatic primary amine. Generally, the aliphatic group, preferably an alkyl group, contains from about 4, or about 6, or about 8 to about 30, or to about 24 carbon atoms. Usually the tertiary alkyl primary amines are monoamines represented by the formula $R_2—C(R_2')_2—NH_2$, wherein $R_2$ is a hydrocarbyl group containing from one to about 27 carbon atoms and $R_2'$ is a hydrocarbyl group containing from 1 to about 12 carbon atoms. Such amines are illustrated by tert-butylamine, tert-hexylamine, 1-methyl-1-amino-cyclohexane, tert-octylamine, tert-decylamine, tert-dodecylamine, tert-tetradecylamine, tert-hexadecylamine, tert-octadecylamine, tert-tetracosanylamine, and tert-octacosanylamine.

Mixtures of amines are also useful for the purposes of this invention. Illustrative of amine mixtures of this type are "Primene 81R" which is a mixture of $C_{11}$–$C_{14}$ tertiary alkyl primary amines and "Primene JMT" which is a similar mixture of $C_{18}$–$C_{22}$ tertiary alkyl primary amines (both are available from Rohm and Haas Company). The tertiary alkyl primary amines and methods for their preparation are known to those of ordinary skill in the art. The tertiary alkyl primary amine useful for the purposes of this invention and methods for their preparation are described in U.S. Pat. No. 2,945,749 which is hereby incorporated by reference for its teaching in this regard.

In another embodiment, the amine is a secondary mine. Specific of secondary amines include dimethylamine, diethylamine, dipropylamine, dibutylamine, diamylamine, dihexylamine, diheptylamine, methylethylamine, ethylbutylamine, ethylamylamine and the like. In one embodiment, the secondary amines may be cyclic amines such as piperidine, piperazine, morpholine, etc.

In another embodiment, the amine is a hydroxyhydrocarbyl amine which contains at least one NH group. Useful hydroxyhydrocarbyl amine may be represented by the formula

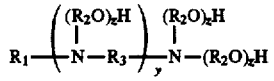

wherein: $R_1$ is a hydrocarbyl group generally containing from about 6 to about 30 carbon atoms; $R_2$ is an alkylene group having from about two to about twelve carbon atoms, preferably an ethylene or propylene group; $R_3$ is an alkylene group containing up to about 5 carbon atoms; y is zero or one; and each z is independently a number from zero to about 10, with the proviso that at least one z is zero.

Useful hydroxyhydrocarbyl amines where y in the above formula is zero include 2-hydroxyethylhexylamine; 2-hydroxyethyloctylamine; 2-hydroxyethylpentadecylamine; 2-hydroxyethyloleylamine; 2-hydroxyethylsoyamine; bis(2-hydroxyethyl)hexylamine; bis(2-hydroxyethyl)oleylamine; and mixtures thereof. Also included are the comparable members wherein in the above formula at least one of x and y is at least 2, as for example, 2-hydroxyethoxyethyl, hexylamine.

In another embodiment, the amine used to make the hydroxyalkyl dithiocarbamate is a polyamine. The polyamines include alkoxylated diamines, fatty polyamine diamines and alkylenepolyamines. Commercially available examples of alkoxylated diamines include those amine where y in the above formula is one. Examples of these amines include Ethoduomeen T/13 and T/20 which are ethylene oxide condensation products of N-tallowtrimethylenediamine containing 3 and 10 moles of ethylene oxide per mole of diamine, respectively.

In another embodiment, the polyamine is a fatty diamine. The fatty diamines include mono- or dialkyl, symmetrical or asymmetrical ethylene diamines, propane diamines (1,2, or 1,3), and polyamine analogs of the above. Suitable commercial fatty polyamines are Duomeen C (N-coco-1,3-diaminopropane), Duomeen S (N-soya-1,3-diaminopropane), Duomeen T (N-tallow-1,3-diaminopropane), and Duomeen O (N-oleyl-1,3-diaminopropane). "Duomeens" are commercially available from Armak Chemical Co., Chicago, Ill.

In another embodiment, the polyamine is an alkylenepolyamine. Such alkylenepolyamines include methylenepolyamines, ethylenepolyamines, butylenepolyamines, propylenepolyamines, pentylenepolyamines, etc. The higher homologs and related heterocyclic amines such as piperazines and N-amino alkyl-substituted piperazines are also included. Specific examples of such polyamines are ethylenediamine, triethylenetetramine, tris-(2-aminoethyl)amine, propylenediamine, trimethylenediamine, tripropylenetetramine, tetraethylenepentamine, hexaethyleneheptamine, pentaethylenehexamine, etc.

Higher homologs obtained by condensing two or more of the above-noted alkylenepolyamines are similarly useful as are mixtures of two or more of the above described polyamines.

Preferably the polyamines are ethylenepolyamines. Such polyamines are described in detail under the heading Ethylenediamines in Kirk Othmer's "Encyclopedia of Chemical Technology", 2nd Edition, Vol. 7, pages 22–37, Interscience Publishers, New York (1965). Such polyamines are most conveniently prepared by the reaction of ethylene dichloride with ammonia or by reaction of an ethyleneimine with a ring opening reagent such as water, ammonia, etc. These reactions result in the production of a complex mixture of polyalkylenepolyamines including cyclic condensation products such as piperazines. Ethylenepolyamines mixtures are useful.

Other useful types of polyamine mixtures are those resulting from stripping of the above-described polyamine mixtures to leave as residue what is often termed "polyamine bottoms". In general, alkylenepolyamine bottoms can be characterized as having less than two, usually less than 1% (by weight) material boiling below about 200° C. A typical sample of such ethylenepolyamine bottoms obtained from the Dow Chemical Company of Freeport, Tex. designated "E-100" has a specific gravity at 15.6° C. of 1.0168, a percent nitrogen by weight of 33.15 and a viscosity at 40° C. of 121 centistokes. Gas chromatography analysis of such a sample contains about 0.93% "Light Ends" (most probably diethylenetriamine (DETA)), 0.72% triethylenetetramine TETA, 21.74% tetraethylenepentaamine and 76.61% pentaethylene hexamine and higher (by weight). These alkylenepolyamine bottoms include cyclic condensation products such as piperazine and higher analogs of diethylenetriamine, triethylenetetramine and the like.

U.S. Pat. No. 4,234,435 describes useful mono- and polyamines which may be used to prepare the hydroxyalkyl dithiocarbamate, especially at Col. 21, line 4 to Col. 27, line 50. This patent and these passages are incorporated by reference for such description of amines.

In another embodiment, the amine used to prepare the hydroxyalkyl dithiocarbamate is an acylated amine having at least one NH group. The acylated amine is prepared by reacting one or more of the above described amine, preferably an alkylenepolyamine, with a carboxylic acylating agent. Generally, one equivalent of carboxylic acylating agent is reacted with two or more equivalents of the amines.

The carboxylic acylating agents include dimer acids, addition dicarboxylic acids, trimer acids, addition tricarboxylic acids, and hydrocarbyl substituted carboxylic acylating agents.

The dimer acids include products resulting from the dimerization of unsaturated fatty acids. Fatty acids generally contain from about 8 to about 30, preferably from about 12 to about 24 carbon atoms. Examples of fatty acids include oleic, linoleic, linolenic, tall oil and rosin acids. Generally, the dimer acids have an average from about 18 to about 44, preferably from about 28 to about 40 carbon atoms. In one embodiment, the dimer acids have about 36 carbon atoms. The dimer acids are preferably prepared from $C_{18}$ fatty acids, such as oleic acids. The dimer acids are described in U.S. Pat. Nos. 2,482,760, 2,482,761, 2,731,481, 2,793,219, 2,964,545, 2,978,468, 3,157,681, and 3,256,304, the entire disclosures of which are incorporated herein by reference. Examples of dimer acids include Empol® 1014, 1016 and 1018 Dimer Acid, each available from Emery Industries, Inc. and Hystrene® mer acids 3675, 3680, 3687 and 3695, available from Humko Chemical.

In another embodiment, the carboxylic acylating agents are addition carboxylic acylating agents, which are addition (4+2 and 2+2) products of an unsaturated fatty acid (e.g., the above-described fatty acids, preferably tall oil acids and oleic acids) with alpha, beta ethylenically unsaturated carboxylic acylating agent (e.g., acrylic or methacrylic acylating agents or fumaric acid or maleic acid or anhydride) such as are taught in U.S. Pat. No. 2,444,328, the disclosure of which is incorporated herein by reference. These addition acylating agents include Westvaco® Diacid H-240, 1525 and 1550, each being commercially available from the Westvaco Corporation. Examples of addition tricarboxylic acids include Empol® 1040 available commercially from Emery Industries, Hystrene® 5460 available commercially from Humko Chemical, and Unidyme® 60 available commercially from Union Camp Corporation.

In another embodiment, the carboxylic acylating agents is a hydrocarbyl substituted carboxylic acylating agent. The hydrocarbyl group generally contains from about eight, or preferably from about 12, or from about 16 up to about 200, or preferably up to about 150, or about to about 100 carbon atoms. In one embodiment, the hydrocarbyl group contains up to about 40, preferably up to about 30, or more preferably up to about 24 carbon atoms. In one embodiment, the hydrocarbyl group is derived from an olefin. These olefins are preferably alpha-olefins olefins (sometimes referred to as mono-1-olefins) or isomerized alpha-olefins. Examples of the alpha-olefins include 1-octene, 1-nonene, 1-decene, 1-dodecene, 1-tridecene, 1-tetradecene, 1-pentadecene, 1-hexadecene, 1-heptadecene, 1-octadecene, 1-nonadecene, 1-eieosene, 1-henicosene, 1-docosene, 1-tetracosene, etc. Commercially available alpha-olefin fractions that can be used include the $C_{15-18}$ alpha-olefins, $C_{12-16}$ alpha-olefins, $C_{14-16}$ alpha-olefins, $C_{14-18}$ alpha-olefins, $C_{16-18}$ alpha-olefins olefins, $C_{16-20}$ alpha-olefins, $C_{18-24}$ alpha-olefins, $C_{22-28}$ alpha-olefins, etc. The $C_{16-18}$ and $C_{18-24}$ alpha-olefins are particularly preferred.

In another embodiment, the hydrocarbyl group is derived from a polyalkene having a number average molecular weight from about 500, preferably from about 800 up to about 5000, preferably up to about 2500, more preferably up to about 1200. Number average molecular weight is determined by gel permeation chromatography. The polyalkene is derived from olefins having from about two to about eight carbon atoms, such as ethylene, propylene or butylene, preferably butylene.

In another embodiment the carboxylic acylating agents are hydrocarbyl-substituted succinic acylating agents, preferably acids or anhydrides, more preferably anhydrides. The succinic acylating agents are prepared by reacting the above-described olefins or isomerized olefins with unsaturated carboxylic fumaric acid, or maleic acid, or their anhydrides, at a temperature from about 160° to about 240° C., preferably from about 185° to about 210° C. Free radical inhibitors (e.g., t-butyl catechol) may be used to reduce or prevent the formation of polymeric byproducts. The procedures for preparing the acylating agents are known to those skilled in the art and have been described for example in U.S. Pat. No. 3,412,111; U.S. Pat. No. 4,234,435, issued to Meinhardt et al; and Ben et al, "The Ene Reaction of Maleic Anhydride With Alkenes", J. C. S. Perkin II (1977), pages 535–537. These references are incorporated by reference for their disclosure of procedures for making the above acylating agents.

The hydroxyalkyl dithiocarbamates may be prepared by reacting an amine with carbon disulfide to form a dithiocarbamic acid or salt. This dithiocarbamic acid or salt is then further reacted with an epoxide. In another embodiment, the amine, carbon disulfide and the epoxide are reacted simultaneously.

The epoxide is generally an aliphatic epoxide having at least 2 to about 30 carbon atoms, preferably, from 2 to about 20 carbon atoms. Examples of useful epoxides include ethylene oxide, propylene oxide, 1,2-butene oxide, heptene oxide, octene oxide, oleic acid oxide, methyl oleate oxide, styrene oxide, and epoxidized fats and epoxidized vegetable oils, such as epoxidized soybean oil. Fats and oils are described below. Mixtures of epoxides may also be used, for instance commercial mixtures of epoxides having from 14 to about 16 carbon atoms and 14 to about 18 carbon atoms.

Generally, the reaction temperature is from about −30° C., or from about 0° C., or from about 5° C. up to about 50° C., or up to about 40° C. The amine, carbon disulfide and epoxide are reacted in an equivalent ratio so that the equivalents of amine as determined by NH groups and the equivalents of carbon disulfide equals the equivalents of epoxide. In otherwords, the amines are reacted so that at least one NH group of an amine is reacted with carbon disulfide. If an amine has more than one NH group, then the addition NH groups may be further reacted with additional carbon sulfide, epoxide, or the NH group may remain unreacted with either the carbon disulfide and the epoxide.

(A) Borated Hydroxyalkyl Dithiocarbamates

In another embodiment, the above hydroxyalkyl dithiocarbamates are reacted with a boron compound to form borated hydroxyalkyl dithiocarbamates. The boron compounds include boron oxide, boron oxide hydrate, boron trioxide, boron acids such as boronic acid (i.e., alkyl-B $(OH)_2$ or aryl-$B(OH)_2$), including methyl boronic acid, phenyl-boronic acid, cyclohexyl boronic acid, p-heptylphenyl boronic acid and dodecyl boronic acid, boric acid (i.e., $H_3BO_3$), tetraboric acid (i.e., $H_2B_4O_7$), metaboric acid (i.e., $HBO_2$), boron anhydrides, boron amides and various esters of such boron acids.

The boron acid esters include especially mono-, di-, and tri-organic esters of boric acid with alcohols or phenols such as, e.g., methanol, ethanol, propanol, 1-octanol, benzyl alcohol, ethylene glycol, glycerol, Cellosolve, and phenol. Lower alcohols, 1,2-glycols, and 1,3-glycols, i.e., those having less than about 8 carbon atoms are especially useful for preparing the boric acid esters. Methods for preparing the esters of boron acid are known and disclosed in the art (such as "Chemical Reviews," pp. 959–1064, Vol. 56).

The hydroxyalkyl dithiocarbamates are reacted with the boron compounds at a temperature from about 50° C. up to about 175° C., preferably from about 75° C. up to about 150° C. Generally, from about one equivalent up to about three equivalents of hydroxyalkyl dithiocarbamate are reacted with each boron atom of the boron compound. An equivalent of hydroxyalkyl dithiocarbamates is the based on the number of hydroxyl groups on each molecule. An equivalent of the boron compound is determined by dividing the molecular weight of the boron compound by the number of boron atoms in the boron compound.

Co-borated Products

In another embodiment, the hydroxyalkyl dithiocarbamates are reacted with a boron compound in the presence of a phospholipid or a hydroxy containing carboxylic ester. The co-borated products have improved hydrolytic stability.

The phospholipids may be any lipid containing a phosphoric acid derivative, such as lecithin or cephalin, preferably lecithin or derivatives thereof. Examples of phospholipids include phosphatidylcholine, phosphatidylserine, phosphatidylinositol, phosphatidylethanolamine, phosphatidic acid and mixtures thereof. Preferably, the phospholipids are glycerophospholipids, more preferably, glycero derivatives of the above list of phospholipids. Typically, the glycerophospholipids have one or two acyl groups on a glycerol residue. The each acyl group contains a carbonyl and an alkyl or alkenyl group. The alkyl or alkenyl groups generally contain from about 8 to about 30 carbon atoms, preferably 8 to about 25, more preferably 12 to about 24. Example of these groups include octyl, dodecyl, hexadecyl, octadecyl, docosanyl, octenyl, dodecenyl, hexadecenyl and octadecenyl.

The acyl groups on the glycerophospholipids are generally derived from fatty acids. Fatty acids are acids having from about 8 to about 30 carbon atoms, preferably about 12 to about 24, more preferably about 12 to about 18. Examples of fatty acids include myristic, palmitic, stearic, oleic, linoleic, linolenic, arachidic, arachidonic acids, or mixtures thereof, preferably stearic, oleic, linoleic, and linolenic acids or mixtures thereof.

In the present invention, derivatives of phospholipids may also be used. Derivatives of phospholipids may be acylated or hydroxylated phospholipids. For instance, lecithin as well as acylated and hydroxylated lecithin may be used in the present invention. Acylated lecithin may be prepared by reacting an acylating agent with a lecithin. Acylating agents include acetic acid or derivatives thereof. An example of an acylated lecithin is Thermolec 200 acylated soya lecithin available from Ross & Rowe, Inc. of Decatur, Ill. Hydroxylated lecithin may also be used. Hydroxylated lecithin may be prepared by acidic or enzymatic hydrolysis. An example of hydroxylated lecithin is Thermolec 1018 hydroxylated lecithin available from Ross & Rowe, Inc.

Phospholipids may be prepared synthetically or derived from natural sources. Synthetic phospholipids may be prepared by methods known to those in the art. Naturally derived phospholipids are extracted by procedures known to those in the art. Phospholipids may be derived from animal or vegetable sources. The animal sources include fish, fish oil, shellfish, bovine brain or any egg, preferably chicken eggs. Vegetable sources include rapeseed, sunflower seed, peanut, palm kernel, cucurbit seed, wheat, barley, rice, olive, mango, avocado, palash, papaya, jangli, bodani, carrot, soybean, corn, and cottonseed, more preferably soybean, corn, sunflower seed and cottonseed. Phospholipids may be derived from microorganisms, including blue-green algae, green algae, bacteria grown on methanol or methane and yeasts grown on alkanes.

A useful phospholipid is derived from sunflower seeds. The phospholipid typically contains from about 35 to about 60% phosphatidylcholine, from about 20 to about 35% phosphatidylinositol, from about 1 to about 25% phosphatidic acid and from about 10 to about 25% phosphatidylethanolamine, wherein the percentages are by weight based on the total phospholipids. The fatty acid content is typically about 20–30% by weight palmitic acid, from about 2–10% by weight stearic acid, from about 15–25% by weight oleic acid and from about 40–55% by weight linoleic acid. In one embodiment, the phospholipid is derived from high oleic content sunflower seeds. These seeds typically produce phospholipids having oleic content greater than about 75%, preferably about 80%, more preferably about 85%. The fatty acid content of phospholipids derived from high oleic sunflower seeds generally are about 3.5–4.5% palmitic acid, about 3.0–5.5% stearic acid, about 75–95% oleic acid and about 5–15% linoleic acid. Generally, the phospholipid is derived from a meal produced from high oleic content sunflower seeds. The meal is available commercially under the tradename TRISUN® high oleic sunflower meal available from SVO Enterprises, 35585-B Curtis Boulevard, Eastlake, Ohio 44095.

Phospholipids and lecithin are described in detail in Encyclopedia of Chemical Technology, Kirk and Othmer, 3rd Edition, in "Fats and Fatty Oils", Volume 9, pages 795–831 and in "Lecithin", Volume 14, pages 250–269. The above disclosures of phospholipids and lecithin are hereby incorporated by reference.

In another embodiment, the hydroxyalkyl dithiocarbamates and a hydroxy containing carboxylate are reacted with a boron compound. The hydroxy containing carboxylate are prepared by reacting at least one hydrocarbyl substituted carboxylic acylating agent with at least one polyol. Preferably, the polyols contain from 2 to about 40 carbon atoms, more preferably 2 to about 20; and from 2 to about 10 hydroxyl groups, more preferably 2 to about 6. Polyhydric alcohols include ethylene glycols, including di-, tri- and tetraethylene glycols; propylene glycols, including di-, tri- and tetrapropylene glycols; glycerol; butanediol; hexanediol; sorbitol; arabitol; mannitol; sucrose; fructose; glucose; cyclohexane diol; erythritol; and pentaerythritols, including di- and tripentaerythritol; preferably, diethylene glycol, triethylene glycol, glycerol, sorbitol, pentaerythritol and dipentaerythritol.

The polyhydric alcohols may be esterified with monocarboxylic acids having from 2 to about 30 carbon atoms, preferably about 8 to about 24, more preferably from about 12 to about 22, provided that at least one hydroxyl group remains unesterified. Examples of monocarboxylic acids include acetic, propionic, butyric and the above described fatty carboxylic acids including octanoic, oleic, stearic, linoleic, dodecanoic and tall oil acids. Specific examples of these esterified polyhydric alcohols include sorbitol oleate, including mono- and dioleate, sorbitol stearate, including mono- and distearate, glycerol oleate, including glycerol mono-, and dioleate and erythritol octanoate.

The hydroxy containing carboxylates be prepared by any of several known methods. The esterification is usually carried out at a temperature above about 100° C., preferably between 150° C. and 300° C. The preparation of useful carboxylates is described in U.S. Pat. Nos. 3,522,179 and 4,234,435. These patents are incorporated by references for such descriptions.

Generally, from about one equivalent to about three equivalents of the hydroxyalkyl dithiocarbamate and the phopholipid or the hydroxy containing carboxylate are reacted with each boron atom of the boron compound. The equivalents of the phospholipid and the hydroxy containing carboxylate are based on the number of OH groups in each compound.

In one embodiment, the hydroxyalkyl dithiocarbamates may be co-borated with a monoalcohol containing from about four up to about 30, or preferably from about four up to about twelve carbon atoms. The monoalcohols include butanol, amyl alcohol, 2-ethyl hexanol, isooctanol, dodecanol, cyclohexanol, etc. When the hydroxyalkyl dithiocarbamates are co-borated with the monoalcohol, one boron atom in the boron compound is reacted with from about one to about three equivalents of the mixture of the hydroxyalkyl dithiocarbamate and the monoalcohol.

The following examples relate to hydroxyalkyl dithiocarbamates and borates thereof. In the examples, as well as elsewhere in the specification and claim, parts and percentages are by weight, temperature is in degrees Celsius, pressure is atmospheric, and OH content is determined by acetyl analysis.

EXAMPLE 1

A reaction vessel is charged with 290 grams (5 moles) of propylene oxide and 380 grams (5 moles) of carbon disulfide. The mixture is chilled to 12° C., where 785 grams (5 moles) of diamylamine is added dropwise to the reaction vessel. The reaction temperature increases exothermically and the reaction temperature is maintained between 10° to 17° C. by controlling addition of the amine. The amine is added over four hours. The reaction temperature is maintained at 10° C. to 17° C. for an additional hour. The reaction temperature is increased to 27° C. The reaction mixture is then vacuum stripped to 85° C. and 11 mm Hg. The residue is then warmed to 60° C. and filtered through diatomaceous earth, to yield the desired product. The product is a yellow fluid which has by analysis 4.9% nitrogen, 21.6% sulfur, and 3.9% OH (acetyl analysis).

EXAMPLE 2

A reaction vessel is charged with 241 grams (1 mole) of C16 alpha olefin epoxide and 76 grams (1 mole) of carbon disulfide. Diamylamine (157 grams, 1 mole) is added dropwise to the reaction mixture at 20° C. The reaction temperature increases exothermically, and the reaction temperature is maintained below 30° C. The amine is added over 2.5 hours. The reaction mixture is maintained at 20°–26° C. for one hour. The reaction temperature is heated to 65° C. and the temperature is maintained for two hours. The reaction mixture is vacuum stripped to 110° C. and 15 mm Hg. The residue is the desired product. The product is a clear yellow fluid which has by analysis 3.1% nitrogen, 12.9% sulfur, and 2.3% OH.

EXAMPLE 3

The reaction vessel is charged with 435 grams (7.5 moles) of propylene oxide and 570 grams (7.5 moles) of carbon disulfide. The reaction mixture is cooled to 5° C., where 969 grams (7.5 moles) of dibutylamine is added over 5.5 hours. The reaction mixture is heated to 60° C. and the temperature is maintained for 2 hours.

The reaction mixture is vacuum stripped to 80° C. and 20 mm Hg. The residue is filtered through diatomaceous earth and the filtrate is the desired product. The filtrate has by analysis 5.4% nitrogen, 26.0% sulfur and 4.6% OH.

EXAMPLE 4

A reaction vessel is charged with 117 grams (1.5 moles) of carbon disulfide, 87 grams (1.5 moles) of propylene oxide, and 200 grams of isopropyl alcohol. The reaction mixture is cooled to 7° C., where a mixture containing 585 grams (1.5 moles) of Armeen 2C (a cocoamine available commercially from Akzo Chemical Company) in 400 grams of isopropyl alcohol is added dropwise to the reaction mixture. The addition mixture is heated to 27°–30° C. to maintain clarity during addition. The addition mixture is added over three hours. The temperature is maintained at a 10° C. maximum. The reaction is then maintained at 10°–15° C. for one hour. The reaction mixture is heated to 30° C. over one hour. The reaction temperature increases exothermically to 45° C. The reaction temperature is maintained below 45° C. and in two hours, the reaction temperature then decreases to 20° C. The reaction mixture is then vacuum stripped to 80° C. and 12 mm Hg. The residue is the desired product. The product is a reddish yellow liquid has by analysis 2.9% nitrogen, 14.0% sulfur, and 2.3% OH.

EXAMPLE 5

A reaction vessel is charged with 456 grams (6 moles) of carbon disulfide, 348 grams (6 moles) of propylene oxide and 300 grams of isopropyl alcohol. The mixture is cooled to 5°–10° C., where a blend containing 1050 grams (3 moles) of Duomeen O (N-oleyl-1,3-diaminopropane, commercially available from Akzo Chemical Co.) and 700 grams of isopropyl alcohol is added to the reaction vessel dropwise over four hours. The reaction temperature increases exothermically to 10°–20° C. The reaction temperature is maintained at 20° C. for one hour. The reaction mixture is slowly heated to 45° C. and the reaction temperature is maintained for one hour at 45° C. The reaction mixture is vacuum stripped to 100° C. and 25 mm Hg. The residue is filtered through diatomaceous earth and the filtrate is the desired product. The product has by analysis 4.7% nitrogen, 20.9% sulfur, and 5.2% OH.

EXAMPLE 6

A reaction vessel is charged with 863 grams (1.0 moles) of a reaction product of a $C_{18-24}$ succinic anhydride reacted with Duomeen O in an equal molar basis. A mixture of 73 grams (1.0 moles) of carbon disulfide and 56 grams (1.0 mole) of propylene oxide is added to the reaction vessel at room temperature. The reaction temperature increases to 35°–40° C. exothermically, and the reaction is maintained below 35° C. The mixture of carbon disulfide and propylene oxide is added over 0.75 hours. The reaction temperature is maintained below 30° C. for one hour. The reaction temperature is increased to 50° C. and the temperature is maintained for two hours. The reaction mixture is heated to 80° C. and stripped to 20 mm Hg. The residue is the desired product. The product has by analysis 3.0% nitrogen, 6.1% sulfur, and 1.1% OH.

EXAMPLE 7

A reaction vessel is charged with 153 grams of the product of Example 1 and 165.5 grams (0.7 moles) of tributylborate. The mixture is heated to 120 °C. and the reaction temperature is maintained for two hours. The reaction mixture is stripped at 120° C. and 20 mm Hg. The residue is cooled to 100° C. and stripped to 3 mm Hg. The residue is the desired product and is a yellow fluid having by analysis 3.5% nitrogen, 15.7% sulfur, 1.2% boron.

EXAMPLE 8

A reaction vessel is charged with 403 grams of the product of Example 1, 100 grams of toluene and 19 grams (0.3 moles) of boric acid. The reaction mixture is heated to 110°–120° C. and the reaction temperature is maintained for three hours. Additional boric acid (3 grams) is added to the reaction mixture at 100° C. The reaction temperature is increased to 120° C. and held for one hour. The reaction mixture is then vacuum stripped to 90° C. and 15 mm Hg. The residue is the desired product and has by analysis 4.7% nitrogen, 21% sulfur, and 0.4% boron.

EXAMPLE 9

A reaction vessel is charged with 440 grams of the product of Example 1, 330 grams (1 mole) of glycerol monooleate, 61.8 grams (1 mole) of boric acid and 100 grams of toluene. The reaction mixture is heated to 95°–110° C. and the mixture is refluxed below 150° C. for three hours. The reaction mixture is stripped to 110° C. and 15 mm Hg. The residue is filtered through diatomaceous earth and the filtrate is the desired product. The product has by analysis 2.7% nitrogen, 12.0% sulfur, and 0.8% boron.

EXAMPLE 10

A reaction vessel is charged with 240 grams of the product of Example 1, 160 grams of lecithin (a mixed phospholipid product from Central Soya Company of Fort Wayne, Ind., available commercially under the tradename Centrophase (typical analyses: % P=1.97, % N=0.75)), and 140 grams of toluene. The mixture is heated to 50° C. where 61.8 grams (1 mole) of boric acid is added to the reaction mixture over 2 minutes. The reaction temperature is increased to 50°–60° C. and the temperature is maintained for 0.5 hours. The reaction temperature is increased to 105° C. and water is removed azeotropically. The reaction temperature is increased to 105°–110° C., and the temperature is maintained for four hours. The reaction temperature is increased to 120° C. and the temperature is maintained for five hours. The reaction mixture is cooled to 90° C. and vacuum stripped to 15 mm Hg. The residue is filtered through diatomaceous earth. The filtrate is the desired product. The product has by analysis 3.0% nitrogen, 12.7% sulfur, 0.7% phosphorus and 3.7% boron.

EXAMPLE 11

A reaction mixture is charged with 500 grams of the product of Example 6, 31 grams (0.5 moles) of boric acid and 200 ml of toluene. The mixture is heated to 130° C. and water is removed azeotropically. After removal of 9 grams of water, 130 grams (1 mole) of 2-ethyl-hexanol is added to the reaction mixture. An additional 18 grams of water is collected azeotropically. The reaction temperature is increased to 140° C. and the reaction mixture is vacuum stripped to 140° C. in 15 mm Hg. The residue is filtered through diatomaceous earth and the filtrate is the desired product. The product has by analysis 4.9% sulfur and 0.8% boron.

EXAMPLE 12

A reaction vessel is charged with 203 grams (2.67 equivalents) of carbon disulfide and 155 grams (2.67 equivalents) of propylene oxide. The mixture is cooled to 10° C. and 750 grams of oleyl amine (2.67 equivalents) is added to the reaction vessel at a rate to maintain the reaction temperature below 25° C. The oleyl amine is added dropwise over two hours. The reaction temperature is then maintained for one hour at 10°–° C. The temperature is increased slowly to 50° C. and the temperature is maintained for one hour. The temperature is then increased to 70° C. and the temperature is maintained for three hours. The reaction mixture is vacuum stripped to 70° C. and 25 mm Hg. The residue is filtered through diatomaceous earth and the filtrate is the desired product. The product has by analysis 3.4% nitrogen, 5.2% sulfur, and 3.5% OH.

EXAMPLE 13

A reaction vessel is charged with 136 grams (1.8 equivalents) of carbon disulfide and 103 grams (1.8 equivalents) of propylene oxide. The mixture is cooled to 10° C. and 500 grams (1.8 equivalents) of oleyl amine are added dropwise over one hour. After addition, the reaction temperature is maintained at 10°–20° C. for one hour. Additional propylene oxide, 104 grams, (1.8 equivalents) is added to dropwise over one-half hour. The reaction temperature is maintained at 20° C. for one hour and slowly warmed to 70° C. The reaction temperature is maintained at 70° C. for three hours. The reaction is then vacuum stripped to 70° C. and 25 mm Hg. The residue is filtered through diatomaceous earth and the filtrate is the desired product. The product has by analysis 3.1% nitrogen, 13.4% sulfur, 4.8% OH, and has infrared bands at 3330.7 $cm^{-1}$, 1659 $cm^{-1}$, and 1458.9 $cm^{-1}$.

EXAMPLE 14

A reaction vessel is charged with 271 grams (3.6 equivalents) of carbon disulfide and 207 grams (3.6 equivalents) of propylene oxide. The solution is cooled to 10° C. where 500 grams (1.8 equivalents) of oleyl amine is added dropwise over one hour. The reaction temperature is increased to 20° C. and the temperature is maintained for one hour. The reaction temperature is increased to 70° C. and maintained for three hours. The reaction mixture is vacuum stripped to 70° C. and 25 mm Hg. The residue is filtered through diatomaceous earth and the filtrate is the desired product. The product has by analysis 3.1% nitrogen, 18.0% sulfur, 4.6% OH, and has infrared bands at 3329.4 $cm^{-1}$, 1655.1 $cm^{-1}$, and 1458.0 $cm^{-1}$.

EXAMPLE 15

A reaction vessel is charged with 380 grams (5 equivalents) of carbon disulfide and 290 grams (5 equivalents) of propylene oxide. The reaction vessel is cooled to 0°–10° C. where 951 grams (5 moles) of Primeen 81R is added dropwise over two hours. The reaction temperature is maintained between 0°–10° C. during addition. The reaction temperature is then increased to 70° C. over a four hour period. The reaction mixture is vacuum stripped to 70° C. and 30 mm Hg. The residue is filtered through diatomaceous earth and the filtrate is the desired product. The product has by analysis 4.4% nitrogen, 19.1% sulfur, 7.1% OH.

EXAMPLE 16

A reaction vessel is charged with 500 grams of the product of Example 15 and 32 grams (0.5 equivalents) of boric acid, and 200 ml of toluene. The reaction mixture is stirred at 130° C. while 28 grams of water is removed azeotropically over four hours. The reaction mixture is stripped at 100° C. and 30 mm Hg. The residue is filtered through diatomaceous earth and the filtrate is the desired product. The product has by analysis 4.6% nitrogen, 17.2% sulfur, and 0.03% boron.

Lubricants

As previously indicated, the hydroxyalkyl dithiocarbamates and borates thereof are useful in lubricants where they can function primarily as antiwear, antiweld, antiscuff, extreme pressure, anticorrosion, antioxidation and/or friction modifying agents. They can be employed in a variety of lubricants based on diverse oils of lubricating viscosity, including natural and synthetic lubricating oils and mixtures thereof. These lubricants include crankcase lubricating oils for spark-ignited and compression-ignited internal combustion engines, including automobile and truck engines, two-cycle engines, aviation piston engines, marine and railroad diesel engines, and the like. They can also be used in natural gas engines, stationary power engines and turbines and the like. Automatic or manual transmission fluids, transaxle lubricants, gear lubricants, both for open and enclosed systems, tractor lubricants, metal-working lubricants, hydraulic fluids and other lubricating oil and grease compositions can also benefit from the incorporation therein of the compositions of the present invention. They may also be used in lubricants, wirerope, walking cam, slideway, rock drill, chain and conveyor belt, worm gear, bearing, and rail and flange applications.

The hydroxyalkyl dithiocarbamates and borates thereof may be used in lubricants or in concentrates. The concentrate may contain the dithiocarbamates or other components used in preparing fully formulated lubricants. The concentrate also contains a substantially inert organic diluent, which includes kerosene, mineral distillates, or one or more of the oils of lubricating viscosity discussed below. In one embodiment, the concentrates contain from about 0.01%, or from about 0.1%, or from about 1% up to about 70% or up to about 80%, even up to about 90% by weight of the hydroxyalkyl dithiocarbamates and borates thereof.

The hydroxyalkyl dithiocarbamates and borates thereof may be present in a final product, blend, or concentrate in any amount effective in lubricating compositions. Generally they are present in the lubricating composition in an amount from about 0.01%, or from about 0.1%, or from about 0.5%, or from about 1% up to about 10%, or up to about 5% by weight. In one embodiment, when the hydroxyalkyl dithiocarbamates and borates thereof are used in oils, such as gear oils, they are preferably present in an amount from about 0.5%, or from about 1%, or from about 1.5% up to about 8%, or up to 5%, or up to about 4% by weight of the lubricating composition. When the hydroxyalkyl dithiocarbamates and borates thereof are used in hydraulic fluids, they are generally present in an amount from about 0.01%, or from about 0.3% up to about 2%, or up to about 1% by weight of the hydraulic fluid.

In one embodiment, the lubricating composition contains less than about 2%, or less than about 1.5%, or less than about 1.0%, or less than about 0.5% by weight of reaction product of a polyisobutenyl substituted succinic anhydride 6 and a polyalkylene polyamine. In another embodiment, the lubricating compositions, such as gear lubricants, contain less than 2%, or less than 1.5%, or less than 1% by weight of a dispersant, such as those described herein. The dispersants may include carboxylic dispersants, amine dispersants, Mannich dispersants, post-treated dispersants and polymeric dispersants.

The lubricating compositions and methods of this invention employ an oil of lubricating viscosity, including natural or synthetic lubricating oils and mixtures thereof. Natural oils include animal oils, vegetable oils, mineral lubricating oils, and solvent or acid treated mineral oils. Synthetic lubricating oils include hydrocarbon oils (polyalphaolefins), halo-substituted hydrocarbon oils, alkylene oxide polymers, esters of dicarboxylic acids and polyols, esters of phosphorus-containing acids, polymeric tetrahydrofurans and silicon-based oils. Unrefined, refined, and rerefined oils, either natural or synthetic, may be used in the compositions of the present invention. A description of oils of lubricating viscosity occurs in U.S. Pat. No. 4,582,618 (column 2, line 37 through column 3, line 63, inclusive), herein incorporated by reference for its disclosure to oils of lubricating viscosity.

In one embodiment, the oil of lubricating viscosity or a mixture of oils of lubricating viscosity are selected to provide lubricating compositions with a kinematic viscosity of at least about 3.5 cSt, or at least about 4.0 cSt at 100° C. In one embodiment, the lubricating compositions have an SAE gear viscosity number of at least about SAE 65, more preferably at least about SAE 75. The lubricating composition may also have a so-called multigrade rating such as SAE 75W-80, 75W-90, 75W-90, or 80W-90. Multigrade lubricants may include a viscosity improver which is formulated with the oil of lubricating viscosity to provide the above lubricant grades. Useful viscosity improvers include but are not limited to polyolefins, such as ethylene-propylene copolymers, or polybutylene rubbers, including hydrogenated rubbers, such as styrene-butadiene or styrene-isoprene rubbers; or polyacrylates, including polymethacrylates. Preferably the viscosity improver is a polyolefin or polymethacrylate, more preferably polymethacrylate. Viscosity improvers available commercially include Acryloid™ viscosity improvers available from Rohm & Haas; Shellvis™ rubbers available from Shell Chemical; and Lubrizol 3174 available from The Lubrizol Corporation.

In another embodiment, the oil of lubricating viscosity is selected to provide lubricating compositions for crankcase applications, such as for gasoline and diesel engines. Typically, the lubricating compositions are selected to provide an SAE crankcase viscosity number of 10W, 20W, or 30W lubricants. The lubricating composition may also have a so called multi-grade rating such as SAE 5W-30, 10W-30, 10W-40, 20W-50, etc. As described above, multi-grade lubricants include a viscosity improver which is formulated with the oil of lubricating viscosity to provide the above lubricant grades.

(B) Sulfur Compounds

In one embodiment, the hydroxyalkyl dithiocarbamates and borates thereof may be used in combination with a sulfur compound. The sulfur compound is present in an amount from about 0.05%, or from about 0.1%, or from about 1%, or from about 1.5% by weight of the lubricating composition. The sulfur compound is generally present in an amount up to about 10%, or up to about 7%, or up to about by weight of the lubricating composition.

The sulfur compounds include mono- or polysulfide compositions, or mixtures thereof. In one embodiment, the organic polysulfides may be a mixture of di-, tri- or tetra-sulfide materials, preferably having a majority of trisulfide being preferred. Materials having at least 70% trisulfide are preferred, with materials containing greater than 80% trisulfide more preferred.

Materials which may be sulfurized include oils, fatty acids or esters, olefins or polyolefins made therefrom, terpenes, or Diels-Alder adducts. Oils which may be sulfurized are unsaturated natural or synthetic oils, including mineral oils, lard oil, carboxylic acid esters derived from aliphatic alcohols and unsaturated fatty acids or aliphatic carboxylic acids (e.g., myristyl oleate and oleyl oleate) and synthetic unsaturated esters or glycerides. Fatty acids generally contain from about 8 up to about 30, preferably from about 10 up to about 24, more preferably from 12 up to about 22, or up to about 18 carbon atoms. The fatty acids include palmitoleic acid, oleic acid, linoleic acid, linolenic acid, erucic acid, lard oil acid, tall oil acid, soybean oil acid, etc.

The unsaturated fatty acid esters include fatty oils, that is, naturally occurring or synthetic esters of glycerol and one or more of the above fatty acids. Examples of fatty acid esters include animal fats such as Neat's-foot oil, lard oil, depot fat, beef tallow, vegetable oils include cottonseed oil, corn oil, safflower oil, sesame oil, soybean oil, sunflower seed oil, etc. The fatty acid esters also may be prepared by esterifying alcohols and polyols with a fatty acid. The alcohols include the above described mono- and polyhydric alcohols, such as methanol, ethanol, propanol, butanol, ethylene glycol, neopentyl glycol, glycerol, etc. In one embodiment, the unsaturated fatty esters may be sulfurized in combination with one or more of the olefins described herein.

The olefins contain at least one olefinic double bond, which is defined as a non-aromatic double bond. The olefins include the above describe alpha olefins. In its broadest sense, the olefin may be defined by the formula $R^{*1}R^{*2}C{=}CR^{*3}R^{*4}$, wherein each of $R^{*1}$, $R^{*2}$, $R^{*3}$, and $R^{*4}$ is hydrogen, or an organic group. In general, the R groups in the above formula which are not hydrogen may be represented by $-(CH_2)_n-A$, wherein n is a number from 0–10 and A is represented by $-C(R^{*5})_3$, $-COOR^{*5}$, $-CON(R^{*5})_2$, $-COON(R^{*5})_4$, —COOM, —CN, —X, $-YR^{*5}$ or —Ar, wherein: each $R^{*5}$ is independently hydrogen, or a hydrocarbyl group, with the proviso that any two $R^{*5}$ groups may be connected to form a ring of up to about 12 carbon atoms is formed; M is one equivalent of a metal cation (preferably Group I or II, e.g., sodium, potassium, barium, calcium); X is halogen (e.g., chloro, bromo, or iodo); Y is oxygen or divalent sulfur; Ar is an aromatic group of up to about 12 carbon atoms.

The olefinic compound is usually one in which each R group which is not hydrogen is independently alkyl, alkenyl or aryl group. In one embodiment, $R^{*3}$and $R^4$ are hydrogen and $R^{*1}$ and $R^{*2}$ are alkyl or aryl, especially alkyl having 1 to about 30, or to about 16, or to about 8, or even to about 4 carbon atoms. Olefins having about 3 to about 30, or to about 16 (most often less than about 9) carbon atoms are particularly useful. Olefins having two to about 5 or to about 4 carbon atoms are particularly useful. Isobutene, propylene and their dimers, trimers and tetramers, and mixtures thereof are especially preferred olefins. Of these compounds, isobutylene and diisobutylene are particularly desirable.

The sulfurized olefins may be produced by reacting sulfur monochloride with an olefin, and then treating the resulting product with an alkali metal sulfide in the presence of free sulfur. The resulting product is then treated with an inorganic base. The sulfurized olefin may also be prepared by the reacting, under superatmospheric pressure, the olefin with a mixture of sulfur and hydrogen sulfide in the presence, or absence, of a catalyst, followed by removal of low boiling materials. The olefins which may be sulfurized, the sulfurized olefin, and methods of preparing the same are described in U.S. Pat. Nos. 4,119,549, 4,199,550, 4,191,659, and 4,344,854. The disclosure of these patents is hereby incorporated by reference for its description of the sulfurized olefins and preparation of the same.

In another embodiment, the sulfur compound is a sulfurized terpene compound. The term "terpene compound", as used in the specification and claims, is intended to include the various isomeric terpene hydrocarbons having the empirical formula $C_{10}H_{16}$, such as contained in turpentine, pine oil and dipentenes, and the various synthetic and naturally occurring oxygen-containing derivatives. Pine-oil derivatives, which are commercially available from Hercules Incorporated, include alpha-Terpineol (a high purity tertiary terpene alcohol); and Terpineol 318 Prime (a mixture containing about 60–65% weight alpha-terpineol and 15–20% weight beta-terpineol); Yarmor 302; Herco pine oil; Yarmor 302W; Yarmor F; and Yarmor 60.

In another embodiment, the sulfur compound is a sulfurized Diels Alder adduct. Generally, the molar ratio of sulfur source to Diels-Alder adduct is in a range of from about 0.75, preferably about 1, up to about 4.0, preferably up to about 3.0, more preferably up to about 2.5. The Diels-Alder adducts are a well-known, art-recognized class of compounds prepared from dienes by Diels-Alder reaction. A Diels-Alder reaction involves the reaction of at least one conjugated diene with at least one ethylenically or acetylenically unsaturated compound, these latter compounds being known as dienophiles. Piperylene, isoprene, methylisoprene, chloroprene, and 1,3-butadiene are among the preferred dienes for use in preparing the Diels-Alder adducts. Other dienes include linear 1,3-conjugated dienes, cyclic dienes, such as cyclopentadienes, fulvenes, 1,3-cyclohexadienes, 1,3,5-cycloheptatrienes, cyclooctatetraene, etc.

Dienophiles, used in preparing the Diels-Alder adducts, include nitroalkenes; alpha, beta-ethylenically unsaturated carboxylic esters, acids or amides; ethylenically unsaturated aldehydes and vinyl ketones. The unsaturated carboxylic esters, acids and amides are described above. Specific examples of dienophiles include 1-nitrobutene-1, alkylacrylates, acrylamide, dibutylacrylamide, methacrylamide, crotonaldehyde; crotonic acid, dimethyl divinyl ketone, methylvinyl ketone, propiolaldehyde, methyl ethynyl ketone, propiolic acid, propargylaldehyde, cyclopentenedione, 3-cyanocoumaran, etc. The sulfurized Diels-Alder adducts are readily prepared by heating a mixture of a sulfur source, preferably sulfur and at least one of the Diels-Alder adducts of the types discussed hereinabove at a temperature within the range of from about 110° C. to just below the decomposition temperature of the Diels-Alder adducts. Temperatures within the range of about 110° to about 200° C. will normally be used. An example of a useful sulfurized Diels-Alder adduct is a sulfurized reaction product of butadiene and butyl-acrylate. Sulfurized Diels Alder adducts are described in U.S. Pat. Nos. 3,498,915, 4,582,618, and Re 27331. These patents are hereby incorporated by reference for their disclosures of sulfurized Diels Alder adducts and methods of making the same.

In one preferred embodiment, the organic polysulfide comprise sulfurized olefins, where the olefins are described above. For example, organic polysulfides may be prepared by the sulfochlorination of olefins containing four or more carbon atoms and further treatment with inorganic higher polysulfides according to U.S. Pat. No. 2,708,199.

In one embodiment, sulfurized olefins are produced by (1) reacting sulfur monochloride with a stoichiometric excess of a lower olefin, e.g. containing two to about seven carbon atoms, (2) treating the resulting product with an alkali metal sulfide in the presence of free sulfur in a mole ratio of no less than 2:1 in an alcohol-water solvent, and (3) reacting that product with an inorganic base. This procedure is described in U.S. Pat. No. 3,471,404, and the disclosure of U.S. Pat. No. 3,471,404 is hereby incorporated by reference for its discussion of this procedure for preparing sulfurized olefins and the sulfurized olefins thus produced. Generally, the olefin reactant contains from about 2 to 5 carbon atoms and examples include ethylene, propylene, butylene, isobutylene, amylene, etc.

The sulfurized olefins which are useful in the compositions of the present invention also may be prepared by the reaction, under superatmospheric pressure, of olefinic compounds with a mixture of sulfur and hydrogen sulfide in the presence of a catalyst, followed by removal of low boiling materials. This procedure for preparing sulfurized compositions which are useful in the present invention is described in U.S. Pat. No. 4,191,659, the disclosure of which is hereby incorporated by reference for its description of the preparation of useful sulfurized compositions.

The following example relates to organic polysulfides.

EXAMPLE S-1

Sulfur (526 parts, 16.4 moles) is charged to a jacketed, high-pressure reactor which is fitted with an agitator and internal cooling coils. Refrigerated brine is circulated through the coils to cool the reactor prior to the introduction of the gaseous reactants. After sealing the reactor, evacuating to about 2 torr and cooling, 920 parts (16.4 moles) of isobutene and 279 parts (8.2 moles) of hydrogen sulfide are charged to the reactor. The reactor is heated using steam in the external jacket, to a temperature of about 182° C. over about 1.5 hours. A maximum pressure of 1350 psig is reached at about 168° C. during this heat-up. Prior to reaching the peak reaction temperature, the pressure starts to decrease and continues to decrease steadily as the gaseous reactants are consumed. After about 10 hours at a reaction temperature of about 182° C., the pressure is 310–340 psig and the rate of pressure change is about 5–10 psig per hour. The unreacted hydrogen sulfide and isobutene are vented to a recovery system. After the pressure in the reactor has decreased to atmospheric, the sulfurized mixture is recovered as a liquid.

The mixture is blown with nitrogen at about 100° C. to remove low boiling materials including unreacted isobutene, mercaptans and monosulfides. The residue after nitrogen blowing is agitated with 5% Super Filtrol and filtered, using a diatomaceous earth filter aid. The filtrate is the desired sulfurized composition which contains 42.5% sulfur.

(C) Phosphorus or Boron Agents

In one embodiment, the hydroxyalkyl dithiocarbamates and borates thereof are used with (C) at least one phosphorus or boron containing antiwear/extreme pressure agent. In this embodiment, the phosphorus or boron containing antiwear/extreme pressure agent is present in an amount sufficient to impart antiwear, antiweld, and/or extreme pressure properties to the lubricants and functional fluids. The phosphorus or boron antiwear/extreme pressure agents (C) are typically present in the lubricants and functional fluids at a level of up to about 20% by weight, preferably up to about 10% by weight, based on the total weight of the lubricant, functional fluid, or grease. Typically, the phosphorus or boron containing antiwear/extreme pressure agent is present in the lubricants and functional fluids at a level from about 0.01%, or from about 0.05%, or from about 0.08% by weight. The phosphorus or boron containing antiwear/extreme pressure agent is present in an amount up to about 10%, or up to about 3%, or up to about 2% by weight. In one embodiment, the lubricating compositions, functional fluids, and greases contain more than 0.01% phosphorus preferably greater than 0.05% phosphorus.

Examples of phosphorus or boron containing antiwear/extreme pressure agents (C) include a metal thiophosphate; a phosphoric acid ester or salt thereof; a phosphite; a phosphorus-containing carboxylic acid, ester, ether, or amide; a borated dispersant; an alkali metal borate; a borated overbased compound; a borated fatty amine; a borated phospholipid; and a borate ester. The phosphorus acids include the phosphoric, phosphonic, phosphinic and thiophosphoric acids including dithiophosphoric acid as well as the monothiophosphoric acid, thiophosphinic and thiophosphonic acids.

In one embodiment, phosphorus or boron containing antiwear/extreme pressure agent (C) is a phosphorus acid ester prepared by reacting one or more phosphorus acid or anhydride with an alcohol containing from one to about 30, preferably from two to about 24, more preferably from about 3 to about 12 carbon atoms. The phosphorus acid or anhydride is generally an inorganic phosphorus reagent, such as phosphorus pentoxide, phosphorus trioxide, phosphorus tetroxide, phosphorous acid, phosphoric acid, phosphorus halide, lower phosphorus esters, or a phosphorus sulfide, including phosphorus pentasulfide, and the like. Lower phosphorus acid esters generally contain from 1 to about 7 carbon atoms in each ester group. The phosphorus acid ester may be a mono-, di- or trihydrocarbyl phosphoric acid ester. Alcohols used to prepare the phosphorus acid esters include butyl, amyl, 2-ethylhexyl, hexyl, octyl, and oleyl alcohols, and phenols, such as cresol. Examples of commercially available alcohols include Alfol 810 (a mixture of primarily straight chain, primary alcohols having from 8 to 10 carbon atoms); Alfol 1218 (a mixture of synthetic, primary, straight-chain alcohols containing 12 to 18 carbon atoms); Alfol 20+ alcohols (mixtures of $C_{18}$–$C_{28}$ primary alcohols having mostly $C_{20}$ alcohols as determined by GLC (gas-liquid-chromatography)); and Alfol 22+ alcohols ($C_{18}$–$C_{28}$ primary alcohols containing primarily $C_{22}$ alcohols). Alfol alcohols are available from Continental Oil Company.

Another example of a commercially available alcohol mixtures are Adol 60 (about 75% by weight of a straight chain $C_{22}$ primary alcohol, about 15% of a $C_{20}$ primary alcohol and about 8% of $C_{18}$ and $C_{24}$ alcohols) and Adol 320 (oleyl alcohol). The Adol alcohols are marketed by Ashland Chemical.

A variety of mixtures of monohydric fatty alcohols derived from naturally occurring triglycerides and ranging in chain length of from $C_8$ to $C_{18}$ are available from Procter & Gamble Company. These mixtures contain various amounts of fatty alcohols containing mainly 12, 14, 16, or 18 carbon atoms. For example, CO-1214 is a fatty alcohol mixture containing 0.5% of $C_{10}$ alcohol, 66.0% of $C_{12}$ alcohol, 26.0% of $C_{14}$ alcohol and 6.5% of $C_{16}$ alcohol.

Another group of commercially available mixtures include the "Noedol" products available from Shell Chemical Co. For example, Noedol 23 is a mixture of $C_{12}$ and $C_{13}$ alcohols; Noedol 25 is a mixture of $C_{12}$ and $C_{15}$ alcohols; and Noedol 45 is a mixture of $C_{14}$ to $C_{15}$ linear alcohols. Noedol 91 is a mixture of $C_9$, $C_{10}$ and $C_{11}$ alcohols.

Fatty vicinal diols also are useful and these include those available from Ashland Oil under the general trade designation Adol 114 and Adol 158. The former is derived from a straight chain alpha olefin fraction of $C_{11}$–$C_{14}$, and the latter is derived from a $C_{15}$–$C_{18}$ fraction.

Examples of useful phosphorus acid esters include the phosphoric acid esters prepared by reacting a phosphoric acid or anhydride with cresol alcohols. An example of these phosphorus acid esters is tricresylphosphate.

In another embodiment, the phosphorus or boron antiwear/extreme pressure agent (C) is a thiophosphorus acid ester or salt thereof. The thiophosphorus acid esters may be prepared by reacting phosphorus sulfides, such as those described above, with alcohols, such as those described above. The thiophosphorus acid esters may be mono- or dithiophosphorus acid esters. Thiophosphorus acid esters are also referred to generally as thiophosphoric acids.

In one embodiment, the phosphorus acid ester is a monothiophosphoric acid ester or a monothiophosphate. Monothiophosphates may be prepared by the reaction of a sulfur source with a dihydrocarbyl phosphite. The sulfur source may for instance be elemental sulfur. The sulfur source may also be a sulfide, such as a sulfur coupled olefin or a sulfur coupled dithiophosphate. Elemental sulfur is a preferred sulfur source. The preparation of monothiophosphates is disclosed in U.S. Pat. No. 4,755,311 and PCT Publication WO 87/07638, which are incorporated herein by reference for their disclosure of monothiophosphates, sulfur sources, and the process for making monothiophosphates. Monothiophosphates may also be formed in the lubricant blend by adding a dihydrocarbyl phosphite to a lubricating composition containing a sulfur source, such as a sulfurized olefin. The phosphite may react with the sulfur source under blending conditions (i.e., temperatures from about 30° C. to about 100° C. or higher) to form the monothiophosphate.

In another embodiment, the phosphorus or boron antiwear/extreme pressure agent (C) is a dithiophosphoric acid or phosphorodithioic acid. The dithiophosphoric acid may be represented by the formula $(R_4O)_2PSSH$ wherein each $R_4$ is independently a hydrocarbyl group containing from about 3 to about 30, preferably from about 3 up to about 18, more preferably from about 3 up to about 12, or more preferably up to about 8 carbon atoms. Examples $R_4$ include isopropyl, isobutyl, n-butyl, sec-butyl, the various amyl, n-hexyl, methylisobutyl carbinyl, heptyl, 2-ethylhexyl, isooctyl, nonyl, biphenyl, decyl, dodecyl, and tridecyl groups. Illustrative lower alkylphenyl $R_4$ groups include butylphenyl, amylphenyl, heptylphenyl, etc. Examples of mixtures of $R_4$ groups include: 1-butyl and 1-octyl; 1-pentyl and 2-ethyl-1-hexyl; isobutyl and n-hexyl; isobutyl and isoamyl; 2-propyl and 2-methyl-4-pentyl; isopropyl and sec-butyl; and isopropyl and isooctyl.

In one embodiment, the dithiophosphoric acid may be reacted with an epoxide or a polyhydric alcohol, such as glycerol. This reaction product may be used alone, or further reacted with a phosphorus acid, anhydride, or lower ester. The epoxide is generally an aliphatic epoxide or a styrene oxide. Examples of useful epoxides include ethylene oxide, propylene oxide, butene oxide, octene oxide, dodecene oxide, styrene oxide, etc. Ethylene oxide and propylene oxide are preferred. The polyhydric alcohols are described above. The glycols may be aliphatic glycols having from 1 to about 12, preferably about 2 to about 6, more preferably 2 or 3 carbon atoms. Glycols include ethylene glycol, propylene glycol, and the like. The dithiophosphoric acids, glycols, epoxides, inorganic phosphorus reagents and methods of reacting the same are described in U.S. Pat. No. 3,197,405 and U.S. Pat. No. 3,544,465 which are incorporated herein by reference for their disclosure to these.

The following Examples P-1 and P-2 exemplify the preparation of useful phosphorus acid esters.

EXAMPLE P-1

Phosphorus pentoxide (64 grams) is added at 58° C. over a period of 45 minutes to 514 grams of hydroxypropyl O,O-di(4-methyl-2pentyl)phosphorodithioate (prepared by reacting di(4-methyl-2pentyl)-phosphorodithioic acid with 1.3 moles of propylene oxide at 25° C). The mixture is heated at 75° C. for 2.5 hours, mixed with a diatomaceous earth and filtered at 70° C. to obtain the desired product. The product has by analysis 11.8% by weight phosphorus, 15.2% by weight sulfur, and an acid number of 87 (bromophenol blue).

EXAMPLE P-2

A mixture of 667 grams of phosphorus pentoxide and the reaction product of 3514 grams of diisopropyl phosphorodithioic acid with 986 grams of propylene oxide at 50° C. is heated at 85° C. for 3 hours and filtered. The filtrate has by analysis 15.3% by weight phosphorus, 19.6% by weight sulfur, and an acid number of 126 (bromophenol blue).

Acidic phosphoric acid esters may be reacted with an amine compound or metallic base to form an amine or metal salt. The salts may be formed separately and then the salt of the phosphorus acid ester may be added to the lubricating composition. Alternatively, the salts may also be formed in situ when the acidic phosphorus acid ester is blended with other components to form a fully formulated lubricating composition.

The amine salts of the phosphorus acid esters may be formed from ammonia, or an amine, including monoamines and polyamines. The amines may be primary amines, secondary amines or tertiary amines. Useful amines include those amines disclosed in U.S. Pat. No. 4,234,435 at Col. 21, line 4 to Col. 27, line 50, these passages being incorporated herein by reference. The amines are described above. In one embodiment, the amine may be a hydroxyhydrocarbyl amine, where referring to the above formula, y equals zero. These hydroxyhydrocarbyl amines are available from the Akzo Chemical Division of Akzona, Inc., Chicago, Ill., under the general trade designations "Ethomeen" and "Propomeen". Specific examples of such products include: Ethomeen C/15 which is an ethylene oxide condensate of a coconut fatty acid containing about 5 moles of ethylene oxide; Ethomeen C/20 and C/25 which are ethylene oxide condensation products from coconut fatty acid containing about 10 and 15 moles of ethylene oxide, respectively; Ethomeen O/12 which is an ethylene oxide condensation product of oleyl amine containing about 2 moles of ethylene oxide per mole of amine; Ethomeen S/15 and S/20 which are ethylene oxide condensation products with-stearyl amine containing about 5 and 10 moles of ethylene oxide per mole of amine, respectively; Ethomeen T/12, T/15 and T/25 which are ethylene oxide condensation products of tallow amine containing about 2, 5 and 15 moles of ethylene oxide per mole of amine, respectively; and Propomeen O/12 which is the condensation product of one mole of oleyl amine with 2 moles propylene oxide.

The metal salts of the phosphorus acid esters are prepared by the reaction of a metal base with the phosphorus acid ester. The metal base may be any metal compound capable of forming a metal salt. Examples of metal bases include metal oxides, hydroxides, carbonates, sulfates, borates, or the like. The metals of the metal base include Group IA, IIA, IB through VIIB, and VIII metals (CAS version of the Periodic Table of the Elements). These metals include the alkali metals, alkaline earth metals and transition metals. In one embodiment, the metal is a Group IIA metal, such as calcium or magnesium, Group IIB metal, such as zinc, or a Group VIIB metal, such as manganese. Preferably the metal is magnesium, calcium, manganese or zinc. Examples of metal compounds which may be reacted with the phosphorus acid include zinc hydroxide, zinc oxide, copper hydroxide, copper oxide, etc.

In one embodiment, phosphorus or boron containing antiwear/extreme pressure agent (C) is a metal thiophosphate, preferably a metal dithiophosphate. The metal thiophosphate is prepared by means known to those in the art, and may be prepared from one or more of the above thiophosphoric acids. Examples of metal dithiophosphates include zinc isopropyl methylamyl dithiophosphate, zinc isopropyl isooctyl dithiophosphate, barium di(nonyl) dithiophosphate, zinc di(cyclohexyl)dithiophosphate, zinc di(isobutyl)dithiophosphate, calcium di(hexyl) dithiophosphate, zinc isobutyl isoamyl dithiophosphate, and zinc isopropyl secondary-butyl dithiophosphate.

The following Examples P-3 to P-6 exemplify the preparation of useful phosphorus acid ester salts.

EXAMPLE P-3

A reaction vessel is charged with 217 grams of the filtrate from Example P-1. A commercial aliphatic primary amine (66 grams), having an average molecular weight of 191 in which the aliphatic radical is a mixture of tertiary alkyl radicals containing from 11 to 14 carbon atom, is added over a period of 20 minutes at 25°–60° C. The resulting product has by analysis a phosphorus content of 10.2% by weight, a nitrogen content of 1.5% by weight, and an acid number of 26.3.

EXAMPLE P-4

The filtrate of Example P-2 (1752 grams) is mixed at 25°–82° C. with 764 grams of the aliphatic primary amine used in of Example P-3. The resulting product has by analysis 9.95% phosphorus, 2.72% nitrogen, and 12.6% sulfur.

EXAMPLE P-5

Phosphorus pentoxide (852 grams) is added to 2340 grams of iso-octyl alcohol over a period of 3 hours. The temperature increases from room temperature but is maintained below 65° C. After the addition is complete the reaction mixture is heated to 90° C. and the temperature is maintained for 3 hours. Diatomaceous earth is added to the mixture, and the mixture is filtered. The filtrate has by analysis 12.4% phosphorus, a 192 acid neutralization number (bromophenol blue) and a 290 acid neutralization number (phenolphthalein).

The above filtrate is mixed with 200 grams of toluene, 130 grams of mineral oil, 1 gram of acetic acid, 10 grams of water and 45 grams of zinc oxide. The mixture is heated to 60°–70° C. under a pressure of 30 mm Hg. The resulting product mixture is filtered using a diatomaceous earth. The filtrate has 8.58% zinc and 7.03% phosphorus.

EXAMPLE P-6

Phosphorus pentoxide (208 grams) is added to the product prepared by reacting 280 grams of propylene oxide with 1184 grams of O,O-di-isobutylphosphorodithioic acid at 30°–60° C. The addition is made at a temperature of 50°–60° C. and the resulting mixture is then heated to 80° C. and held at that temperature for 2 hours. The commercial aliphatic primary amine identified in Example P-3 (384 grams) is added to the mixture, while the temperature is maintained in the range of 30°–60° C. The reaction mixture is filtered through diatomaceous earth. The filtrate has 9.31% phosphorus, 11.37% sulfur, 2.50% nitrogen, and a base number of 6.9 (bromophenol blue indicator).

In another embodiment, the phosphorus or boron antiwear/extreme pressure agent (C) is a metal salt of (a) at least one dithiophosphoric acid and (b) at least one aliphatic or alicyclic carboxylic acid. The dithiophosphoric acids are described above. The carboxylic acid may be a monocarboxylic or polycarboxylic acid, usually containing from 1 to about 3, or just one carboxylic acid group. The preferred carboxylic acids are those having the formula $R_5COOH$, wherein $R_5$ is an aliphatic or alicyclic hydrocarbyl group preferably free from acetylenic unsaturation. $R_5$ generally contains from about 2, or from about 4 carbon atoms. $R_5$ generally contains up to about 40, or up to about 24, or to up about 12 carbon atoms. In one embodiment, $R_5$ contains from 4, or from about 6 up to about 12, or up to about 8 carbon atoms. In one embodiment, $R_5$ is an alkyl group. Suitable acids include the butanoic, pentanoic, hexanoic, octanoic, nonanoic, decanoic, dodecanoic, octodecanoic and eicosanoic acids, as well as olefinic acids such as oleic, linoleic, and linolenic acids and linoleic acid dimer. A preferred carboxylic acid is 2-ethylhexanoic acid.

The metal salts may be prepared by merely blending a metal salt of a dithiophoshoric acid with a metal salt of a carboxylic acid in the desired ratio. The ratio of equivalents of dithiophosphoric acid to carboxylic acid is from about 0.5 up to about 400 to 1. The ratio may be from 0.5 up to about 200, or to about 100, or to about 50, or to about 20 to 1. In one embodiment, the ratio is from 0.5 up to about 4.5 to one, preferably about 2.5 up to about 4.25 to one. For this purpose, the equivalent weight of a dithiophosphoric acid is its molecular weight divided by the number of —PSSH groups therein, and the equivalent weight of a carboxylic acid is its molecular weight divided by the number of carboxy groups therein.

A second and preferred method for preparing the metal salts useful in this invention is to prepare a mixture of the acids in the desired ratio, such as those described above for the metal salts of the individual metal salts, and to react the acid mixture with one of the above described metal compounds. When this method of preparation is used, it is frequently possible to prepare a salt containing an excess of metal with respect to the number of equivalents of acid present; thus the metal salts may contain as many as 2 equivalents and especially up to about 1.5 equivalents of metal per equivalent of acid may be prepared. The equivalent of a metal for this purpose is its atomic weight divided by its valence. The temperature at which the metal salts are prepared is generally between about 30° C. and about 150° C., preferably up to about 125° C. U.S. Pat. Nos. 4,308,154 and 4,417,990 describe procedures for preparing these metal salts and disclose a number of examples of such metal salts. These patents are hereby incorporated by reference for those disclosures.

In another embodiment, the phosphorus or boron containing antiwear/extreme pressure agent (C) is a phosphite. The phosphite may be a di- or trihydrocarbyl phosphite. Generally, each hydrocarbyl group independently has from 1 to about 30, preferably from one to about 24, more preferably from about 2 to about 18, more preferably up to about 8 carbon atoms. Examples of specific hydrocarbyl groups include propyl, butyl, hexyl, heptyl, octyl, oleyl, linoleyl, stearyl, phenyl, naphthyl, heptylphenol, and mixtures of two or more of thereof. In one embodiment, each hydrocarbyl group is independently propyl, butyl, pentyl, hexyl, heptyl, oleyl, or phenyl. Phosphites and their preparation are known and many phosphites are available commercially. Particularly useful phosphites are dibutyl phosphite, trioleyl phosphite and triphenyl phosphite.

In one embodiment, the phosphorus or boron containing antiwear/extreme pressure agent (C) is a phosphorus containing amide. The phosphorus containing amides are prepared by the reaction of one of the above described phosphorus acids, preferably a dithiophosphoric acid, with an unsaturated amide. Examples of unsaturated amides include acrylamide, N,N'-methylene bis(acrylamide), methacrylamide, crotonamide, and the like. The reaction product of the phosphorus acid and the unsaturated amide may be further reacted with a linking or a coupling compound, such as formaldehyde or paraformaldehyde. The phosphorus containing amides are known in the art and are disclosed in U.S. Pat. Nos. 4,670,169, 4,770,807, and 4,876,374 which are incorporated by reference for their disclosures of phosphorus amides and their preparation.

In one embodiment, the phosphorus or boron antiwear/extreme pressure agent (C) is a phosphorus containing carboxylic ester. The phosphorus containing carboxylic esters are prepared by reaction of one of the above-described phosphorus acids, preferably a dithiophosphoric acid, and an unsaturated carboxylic acid or ester. Examples of unsaturated carboxylic acids and anhydrides include acrylic acid, methacrylic acid, itaconic acid, maleic acid, fumaric acid, and maleic anhydride.

The ester may be represented by one of the formulae: $R_6C{=}C(R_7)C(O)OR_8$, or $R_8O{-}(O)C{-}HC{=}CH{-}C(O)OR_8$, wherein each $R_7$ and $R_8$ are independently hydrogen or a hydrocarbyl group having 1 to about 18, or to about 12, or to about 8 carbon atoms, $R_6$ hydrogen or an alkyl group having from 1 to about 6 carbon atoms. In one embodiment, $R_6$ is preferably hydrogen or a methyl group.

Examples of unsaturated carboxylic esters include methyl acrylate, ethyl acrylate, 2-ethylhexyl acrylate, 2-hydroxyethyl acrylate, ethyl methacrylate, 2-hydroxyethyl methacrylate, 2-hydroxypropyl methacrylate, 2-hydroxypropyl acrylate, ethyl maleate, butyl maleate and 2-ethylhexyl maleate. The above list includes mono- as well as diesters of maleic, fumaric and citraconic acids. If the carboxylic acid is used, the ester may then be formed by subsequent reaction of the phosphoric acid-unsaturated carboxylic acid adduct with an alcohol, such as those described herein.

In one embodiment, the phosphorus or boron containing antiwear/extreme pressure agent (C) is a reaction product of a phosphorus acid, preferably a dithiophosphoric acid, and a vinyl ether. The vinyl ether is represented by the formula $R_9{-}CH_2{=}CH{-}OR_{10}$ wherein $R_9$ is independently hydrogen or a hydrocarbyl group having from 1 up to about 30, preferably up to about 24, more preferably up to about 12 carbon atoms. $R_{10}$ is a hydrocarbyl group defined the same as $R_9$. Examples of vinyl ethers include methyl vinyl ether, propyl vinyl ether, 2-ethylhexyl vinyl ether and the like.

In one embodiment, the phosphorus or boron containing antiwear/extreme pressure agent (C) is a reaction product of a phosphorus acid, preferably a dithiophosphoric acid, and a vinyl ester. The vinyl ester may be represented by the formula $R_{11}CH{=}CH{-}O(O)CR_{12}$, wherein $R_{11}$ is a hydrocarbyl group having from 1 to about 30, or to about 12 carbon atoms, preferably hydrogen, and $R_{12}$ is a hydrocarbyl group having 1 to about 30, or to about 12, or to about 8 carbon atoms. Examples of vinyl esters include vinyl acetate, vinyl 2-ethylhexanoate, vinyl butanoate, etc.

In another embodiment, the phosphorus or boron containing antiwear/extreme pressure agent (C) is an alkali metal borate. Alkali metal borates are generally a hydrated particulate alkali metal borate which are known in the art. Alkali metal borates include mixed alkali and alkaline earth metal borates. These alkali metal borates are available commercially. Representative patents disclosing suitable alkali metal borates and their methods of manufacture include U.S. Pat. Nos. 3,997,454; 3,819,521; 3,853,772; 3,907,601; 3,997,454; and 4,089,790. These patents are incorporated by reference for their disclosures of alkali metal borates and methods of their manufacture.

In another embodiment, the phosphorus or boron containing antiwear/extreme pressure agent (C) is a borated overbased compound. Borated overbased compounds are generally prepared by reacting an overbased compound, such as a carbonated overbased compound with a boron compound such as boric acid. The overbased compounds include basic salts (i.e., overbased salts) of alkali or alkaline earth metals with sulfonic acids, carboxylic acids, phenols or organic phosphorus acids. The phosphorus acids include those prepared by the treatment of a polyalkene with a phosphorizing agent, such as phosphorus pentasulfide. The most commonly used metals are sodium, potassium, lithium, calcium, and magnesium. The term "basic salt" is used to designate metal salts wherein the metal is present in stoichiometrically larger amounts than the organic acid radical. The overbased salts and borated overbased salts are prepared by means known to those in the art. Examples of borated overbased compounds include borated overbased sodium alkylbenzene sulfonate, borated overbased polybutenyl (Mn=950) substituted succinate, and borated overbased magnesium alkylbenzene sulfonate. Patents describing overbased salts, methods of making the salts and components for making the same include U.S. Pat. Nos. 2,501,731; 2,616,911; 2,777,874; 3,384,585; 3,320,162; 3,488,284 and 3,629,109. The disclosure of these patents are hereby incorporated by reference. Borated overbased compositions, lubricating compositions contain the same and methods of preparing borates overbased compositions are found in U.S. Pat. Nos. 4,744,920, 4,792,410, and PCT publication WO 88/03144. The disclosure of these references are hereby incorporated by reference.

In another embodiment, the phosphorus or boron antiwear/extreme pressure agent (C) is a borated fatty amine. The borated amines are prepared by reacting one or more of the above boron compounds, such as boric acid, with a fatty amine, e.g. an amine having from about four to about eighteen carbon atoms. The borated fatty amines are prepared by reacting the amine with the boron compound at about 50° C. to about 300° C., preferably about 100° C. to about 250° C., and at a ratio of 3:1 to 1:3 equivalents of amine to equivalents of boron compound.

In another embodiment, the phosphorus or boron containing antiwear/extreme pressure agent (C) is a borated epoxide. The borated fatty epoxides are generally the reaction product of one or more of the above boron compounds, with at least one epoxide. The epoxide is generally an aliphatic epoxide having at least 8 carbon atoms. The aliphatic epoxides and their examples are described above. The borated fatty epoxides are generally known and are disclosed in U.S. Pat. No. 4,584,115. This patent is incorporated by reference for its disclosure of borated fatty epoxides and methods for preparing the same.

In another embodiment, the phosphorus or boron containing antiwear/extreme pressure agent (C) is a borated phospholipid. The borated phospholipids are prepared by reacting a combination of one or more of the above described phospholipids and one or more of the above described boron compounds. Optionally, the combination may include an amine, an acylated nitrogen compound, such as reaction products of carboxylic acrylating agents and polyamines, a carboxylic ester, such as reaction products of carboxylic acrylating agents and alcohols and optionally amines, a Mannich reaction product, or a basic or neutral metal salt of an organic acid compound.

The reaction of the phospholipid, the boron compound, and the optional components usually occurs at a temperature from about 60° C., or from about 90° C. up to about 160° C., up to about 140° C. The reaction is typically accomplished in about 0.5, or about 2 up to about 10 hours. The boron compound and phospholipid are reacted at an atomic proportion ratio of boron to phosphorus from about one up to about six to one, preferably from about two up to about four to one, more preferably about three to one. When the combination includes additional components, the boron compound is reacted with the mixture of the phospholipid and one or more optional ingredients in an amount of one atomic proportion of boron to an equivalent of the mixture of a phospholipid and an optional ingredient in a ratio from about (1:1), or about (2:1) up to about (6:1), to about (4:1). The equivalents of the mixture are based on the combined equivalents of phospholipid based on phosphorus and equivalents of the optional ingredients.

Other Additives

The invention also contemplates the use of other additives together with the hydroxyalkyl dithiocarbamates and borates thereof. Such additives include, for example, detergents and dispersants, corrosion- and oxidation-inhibiting agents, pour point depressing agents, extreme pressure agents, antiwear agents, color stabilizers and anti-foam agents.

The detergents are exemplified by oil-soluble neutral and basic salts (i.e. overbased salts) of alkali or alkaline earth metals with sulfonic acids, carboxylic acids, phenols or organic phosphorus acids, such as those described above. The oil-soluble neutral or basic salts of alkali or alkaline earth metal salts may also be reacted with a boron compound. Boron compounds are described above. The overbased and borated overbased metal salts are described above.

Detergents and dispersants are known in the art. The following are illustrative.

(1) "Carboxylic dispersants" are the reaction products of carboxylic acids (or derivatives thereof) containing at least about 34 and preferably at least about 54 carbon atoms and nitrogen containing compounds (such as amine), organic hydroxy compounds (such as phenols and alcohols), and/or basic inorganic materials. These reaction products include imide, amide, and ester reaction products of carboxylic acylating agents. The carboxylic dispersants or more of the above describing one or more of the above described hydrocarbyl substituted carboxylic acylating agent with an amine or hydroxy containing compound such as an alcohol. Examples of these materials include succinimide dispersants and carboxylic ester dispersants. Examples of these "carboxylic dispersants" are described in British Patent 1,306,529 and in many U.S. Patents including the following: U.S. Pat. Nos. 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, and Re 26,433.

(2) "Amine dispersants" are the reaction products of relatively high molecular weight aliphatic or alicyclic halides and amines, preferably polyalkylene polyamines. These dispersants are described above as polyalkene-substituted amines. Examples thereof are described for example, in the following U.S. Patents: U.S. Pat. Nos. 3,275,554, 3,438,757, 3,454,555, and 3,565,804.

(3) "Mannich dispersants" are the reaction products of alkylphenols and aldehydes (especially formaldehyde) and amines (especially amine condensates and polyalkylenepolyamines). The materials described in the following U.S. Patents are illustrative: U.S. Pat. Nos. 3,036,003, 3,236,770, 3,414,347, 3,448,047, 3,461,172, 3,539,633, 3,586,629, 3,591,598, 3,634,515, 3,725,480, 3,726,882, and 3,980,569.

(4) "Post-treated dispersants" are the products obtained by post-treating the carboxylic, amine or Mannich dispersants with reagents such as urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. Patents: U.S. Pat. Nos. 3,200,107, 3,282,955, 3,367,943, 3,513,093, 3,639,242, 3,649,659, 3,442,808, 3,455,832, 3,579,450, 3,600,372, 3,702,757, and 3,708,422.

(5) "Polymeric dispersants" are interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. Polymeric dispersants include esters of styrene-maleic anhydride copolymers. Examples thereof are disclosed in the following U.S. Patents: U.S. Pat. Nos. 3,329,658, 3,449,250, 3,519,656, 3,666,730, 3,687,849, and 3,702,300.

The above-noted patents are incorporated by reference herein for their disclosures of ashless dispersants.

Auxiliary extreme pressure agents and corrosion- and oxidation-inhibiting agents which may be included in the lubricants of the invention are exemplified by chlorinated aliphatic hydrocarbons such as chlorinated wax; sulfurized alkylphenol; phosphosulfurized hydrocarbons, such as the reaction product of a phosphorus sulfide with turpentine or methyl oleate; metal thiocarbamates, such as zinc dioctyldithiocarbamate, and barium diheptylphenyl dithiocarbamate; dithiocarbamate esters, such as reaction products of an amine (e.g., butylamine), carbon disulfide, and an unsaturated compound selected from acrylic, methacrylic, maleic, or fumaric acids, esters, or salts and acrylamides; and alkylene- or bis(S-alkyl dithiocarbamoyl)disulfides (also known as sulfur-coupled dithiocarbamate) such as methylene or phenylene coupled bis (dibutyldithiocarbamates). Many of the above-mentioned extreme pressure agents and corrosion- and oxidation-inhibitors also serve as antiwear agents.

Pour point depressants are an additive often included in the lubricating oils described herein. Examples of useful pour point depressants are polymethacrylates; polyacrylates; polyacrylamides; condensation products of haloparaffin waxes and aromatic compounds; vinyl carboxylate polymers; and polymers of dialkylfumarates, vinyl esters of fatty acids and alkyl vinyl ethers. Pour point depressants useful for the purposes of this invention, techniques for their preparation and their uses are described in U.S. Pat. Nos. 2,387,501; 2,015,748; 2,655,479; 1,815,022; 2,191,498;

2,666,746; 2,721,877; 2,721,878; and 3,250,715 which are hereby incorporated by reference for their relevant disclosures.

Antifoam agents are used to reduce or prevent the formation of stable foam. Typical antifoam agents include silicones or organic polymers. Additional antifoam compositions are described in "Foam Control Agents", by Henry T. Kerner (Noyes Data Corporation, 1976), pages 125–162.

The following examples relate to lubricating compositions containing the hydroxyalkyl dithiocarbamates and borates thereof

EXAMPLE I

A lubricant is prepared by incorporating 3% by weight of the product of Example 1 into a SAE 10W-40 lubricating oil mixture.

EXAMPLE II

A gear lubricant is prepared by incorporating 2% by weight of the product of Example 2 and 2% of the product of Example S-1 into an SAE 80W-90 lubricating oil mixture.

EXAMPLE III

A gear lubricant is prepared by incorporating 2% by weight of the product of Example 7, 1.9% by weight of the product of Example S-1; 1.5% by weight of the product of Example P-3 into an SAE 80W-90 lubricating oil mixture.

EXAMPLE IV

A lubricant is prepared as described in Example III except a SAE 10W-40 lubricating oil mixture is used in place of the SAE 80W-90 lubricating oil mixture.

EXAMPLE V

A phosphorus free hydraulic fluid is prepared by incorporating 1.5% by weight of the product of Example 15, 0.2% by weight of 2,6-di-teiary butyl phenol, 0.05% by weight of a neutral calcium sulfonate solution prepared from an alkylbenzene sulfonic acid having a molecular weight of 430 and containing 57% by weight 100 neutral mineral oil and unreacted alkylate sulfonic into a hydraulic base fluid (ISO 46).

EXAMPLE VI

An oil based metal working fluid is prepared by incorporating 3% by weight of the product of Example 1, 2% by weight of a sulfurized mixture of lard oil, oleic acid and $C_{16-18}$ alpha-olefin, and 1% by weight of the neutral calcium solfonate from Example V into a 100 neutral mineral oil.

Grease

Where the lubricant is to be used in the form of a grease, the lubricating oil generally is employed in an amount sufficient to balance the total grease composition and, generally, the grease compositions will contain various quantities of thickeners and other additive components to provide desirable properties. The hydroxyalkyl dithiocarbamates and borates thereof are present in an amount from about 0.5%, or from about 1% by weight. The hydroxyalkyl dithiocarbamates and borates thereof may be used in an amount up to about 10%, or to about 5% by weight.

A wide variety of thickeners can be used in the preparation of the greases of this invention. The thickener is employed in an amount from about 0.5 to about 30 percent, and preferably from 3 to about 15 percent by weight of the total grease composition. Including among the thickeners are alkali and alkaline earth metal soaps of fatty acids and fatty materials having from about 12 to about 30 carbon atoms.

The metals are typified by sodium, lithium, calcium and barium. Examples of fatty materials include stearic acid, hydroxystearic acid, stearin, oleic acid, palmitic acid, myristic acid, cottonseed oil acids, and hydrogenated fish oils.

Other thickeners include salt and salt-soap complexes, such as calcium stearate-acetate (U.S. Pat. No. 2,197,263), barium stearate-acetate (U.S. Pat. No. 2,564,561), calcium stearate-caprylate-acetate complexes (U.S. Pat. No. 2,999,066), calcium salts and soaps of low-intermediate- and high-molecular weight acids and of nut oil acids, aluminum stearate, and aluminum complex thickeners. Useful thickeners include hydrophilic clays which are treated with an ammonium compound to render them hydrophobic. Typical ammonium compounds are tetraalkyl ammonium chlorides. These clays are generally crystalline complex silicates. These clays include bentonite, attapulgite, hectorite, illite, saponite, sepiolite, biotite, vermiculite, zeolite clays and the like.

EXAMPLE G-1

A grease is prepared by incorporating 0.5% by weight of the product of Example of Example 8 and 0.5% by weight of the product of Example S-1 into a Southwest Petro-chem Lithium 12 hydroxy base grease.

EXAMPLE G-2

A grease is prepared by incorporating 0.25% by weight of the product of Example 11, 0.25% by weight of the product of Example S-1, 0.5% by weight of the product of Example P-3, and 1% by weight of tolyltriazole into a Southwest Petro-chem Lithium 12 hydroxy base grease.

Aqueous Compositions

The invention also includes aqueous compositions characterized by an aqueous phase with at least one hydroxyalkyl dithiocarbamate and borate thereof dispersed or dissolved in said aqueous phase. The water-based functional fluids may be in the form of solutions; or micelle dispersions or microemulsions which appear to be true solutions. Preferably, this aqueous phase is a continuous aqueous phase although, in some embodiments, the aqueous phase can be a discontinuous phase.

These aqueous compositions usually contain at least about 25% by weight water. Such aqueous compositions encompass both concentrates containing about 5% to about 80% by weight, preferably from about 40% to about 65% water; and water-based functional fluids containing generally over about 80% by weight of water. The concentrates generally contain less than about 50%, preferably less than about 25%, more preferably less than about 15%, and still more preferably less than about 6% hydrocarbon oil. The hydrocarbon oil may be one or more of the above oils of lubricating viscosity. The water-based functional fluids generally contain less than about 15%, preferably less than about 5%, and more preferably less than about 2% hydrocarbon oil. The hydroxyalkyl dithiocarbamates and borates thereof are generally present in the aqueous compositions in an amount from about 0.2%, or about 0.5%, or about 0.75% up to about 10%, or to about 5%, or to about 2.5% of the aqueous composition.

These concentrates and water-based functional fluids can optionally include other conventional additives commonly employed in water-based functional fluids. These other additives include surfactants; thickeners; oil-soluble, water-insoluble functional additives such as antiwear agents, extreme pressure agents, dispersants, etc.; and supplemental additives such as corrosion-inhibitors, shear stabilizing agents, bactericides, dyes, water-softeners, odor masking agents, antifoam agents and the like.

The surfactants that are useful in the aqueous compositions of the invention can be of the cationic, anionic, nonionic or amphoteric type. Many such surfactants of each type are known to the art. See, for example, McCutcheon's "Emulsifiers & Detergents", 1981, North American Edition, published by McCutcheon Division, MC Publishing Co., Glen Rock, N.J., U.S.A., which is hereby incorporated by reference for its disclosures in this regard. Specific nonionic surfactant types include alkylene oxide treated products, such as ethylene oxide treated phenols and ethylene oxide/propylene oxide block copolymers, alcohols, esters, such as glycerol esters, amines, such as the above hydroxy amines, and amides. Examples of surfactants include alkylene oxide treated alkylphenols, sold commercially under the tradename of Triton® such as Triton® X-100, available commercially from Union Carbide Chemical Company; alkoxylated amines available from Akzo Chemie under the names ETHODUOMEEN® (polyethoxylated diamines), ETHOMEEN® (polyethoxylated aliphatic amines), ETHOMID® (polyethoxylated amides), and ETHO-QUAD (polyethoxylated quaternary ammonium chlorides); tall oil acids, sold under the trade name Unitol DT/40 (available from Union Camp Corp); and the above described hydroxyalkyl amines.

Among the useful anionic surfactant types are the widely known carboxylate soaps, metal organosulfates, metal sulfonates, metal sulfonylcarboxylates, and metal phosphates. Useful cationic surfactants include nitrogen compounds such as amine oxides and the well-known quaternary ammonium salts. Amphoteric surfactants include amino acid-type materials and similar types.

Surfactants are generally employed in effective amounts to aid in the dispersal of the various additives, particularly in the functional additives discussed below of the invention. Preferably, the concentrates can contain up to about 75% by weight, more preferably from about 10% to about 75% by weight of one or more of these surfactants. The water-based functional fluids can contain up to about 15% by weight, more preferably from about 0.05% to about 15% by weight of one or more of these surfactants.

Often the aqueous compositions of this invention contain at least one thickening agent. Generally, these thickening agents can be polysaccharides, including cellulose ethers and esters, such as hydroxyethyl cellulose and the sodium salt of carboxymethyl cellulose, synthetic thickening polymers, or mixtures of two or more of these. Specific examples of such gums are gum agar, guar gum, gum arabic, algin, dextrans, xanthan gum and the like. A thickener can also be synthetic thickening polymers. Representative of them are polyacrylates, polyacrylamides, hydrolyzed vinyl esters, water-soluble homo- and interpolymers of acrylamidoalkane sulfonates and other comonomers such as acrylonitrile, styrene and the like.

Preferred thickening agents include the water-dispersible reaction products formed by reacting at least one hydrocarbyl-substituted succinic acid and/or anhydride wherein the hydrocarbyl group has from about 8, or about 12, or about 16, up to about 40, or to about 30, or to about 24, about 18 carbon atoms, with at least one water-dispersible amine terminated poly(oxyalkylene) or at least one water-dispersible hydroxy-terminated polyoxyalkylene. Examples of water-dispersible amine-terminated poly(oxyalkylene)s that are useful in accordance with the present invention are disclosed in U.S. Pat. Nos. 3,021,232; 3,108,011; 4,444,566; and Re 31,522. The disclosures of these patents are incorporated herein by reference. Water-dispersible amine terminated poly(oxyalkylene)s that are useful are commercially available from the Texaco Chemical Company under the trade name Jeffamine®. Water-dispersible hydroxy-terminated polyoxyalkylenes are commercially available from BASF Wyandotte Corporation under the tradename "Tetronic" and "Pluronic". Useful hydroxy-terminated polyoxyalkylenes are disclosed in U.S. Pat. Nos. 2,674,619 and 2,979,528, which are incorporated herein by reference.

The reaction between the succinic acid and/or anhydride and the amine- or hydroxy-terminated polyoxyalkylene is described in U.S. Pat. No. 4,659,492 this patent is incorporated herein by reference for its teachings with respect to the use of the reaction product of a hydrocarbyl-substituted succinic acid or anhydride and hydroxy-terminated poly(oxyalkylene).

When the thickener is formed using an amine-terminated poly(oxyalkylene), the thickening characteristics of said thickener can be enhanced by combining it with at least one of the above surfactant. When such surfactants are used, the weight ratio of thickener to surfactant is generally in the range of from about 1:5 to about 5:1, preferably from about 1:1 to about 3:1.

Typically, the thickener is present in a thickening amount in the aqueous compositions of this invention. When used, the thickener is generally present at a level of up to about 70% by weight, preferably from about 20% to about 50% by weight of the concentrates of the invention. The thickener is preferably present at a level in the range of from about 1.5% to about 10% by weight, preferably from about 3% to about 6% by weight of the functional fluids of the invention.

The functional additives that may also be included in the aqueous systems are typically oil-soluble, water-insoluble additives which function in conventional oil-based systems as extreme pressure agents, anti-wear agents, load-carrying agents, dispersants, friction modifiers, lubricity agents, etc. They can also function as anti-slip agents, film formers and friction modifiers. As is well known, such additives can function in two or more of the above-mentioned ways; for example, extreme pressure agents often function as load-carrying agents.

The term "oil-soluble, water-insoluble functional additive" refers to a functional additive which is not soluble in water above a level of about 1 gram per 100 parts of water at 25° C, but is soluble in mineral oil to the extent of at least 1 gram per liter at 25° C. These functional additives may also include certain solid lubricants such as graphite, molybdenum disulfide and polytetrafluoroethylene and related solid polymers. These functional additives can also include frictional polymer formers, which form materials which are dispersed in a liquid are believed to polymerize under operating conditions. A specific example of such materials is dilinoleic acid and ethylene glycol combinations which can form a polyester frictional polymer film. These materials are known to the art and descriptions of them are found, for example, in the journal "Wear", Volume 26, pages 369–392, and West German Published Patent Application 2,339,065. These disclosures are hereby incorporated by reference for their discussions of frictional polymer formers.

Typically these functional additives are known metal or amine salts of organo sulfur, phosphorus, boron or carboxylic acids which are the same as or of the same type as used in oil-based fluids and are described above.

Many such functional additives are known to the art. For example, descriptions of additives useful in conventional oil-based systems and in the aqueous systems of this invention are found in "Advances in Petroleum Chemistry and Refining", Volume 8, edited by John J. McKetta, Interscience Publishers, New York, 1963, pages 31–38 inclusive; Kirk-Othmer "Encyclopedia of Chemical Technology", Volume 12, Second Edition, Interscience Publishers, New York, 1967, page 575 et seq.; "Lubricant Additives" by M. W. Ranney, Noyes Data Corporation, Park Ridge, N.J., U.S.A., 1973; and "Lubricant Additives" by C. V. Smallheer and R. K. Smith, The Lezius-Hiles Co., Cleveland, Ohio, U.S.A. These references are hereby incorporated by reference for their disclosures of functional additives useful in the compositions of this invention.

The functional additive can also be a film former such as a synthetic or natural latex or emulsion thereof in water. Such latexes include natural rubber latexes and polystyrene-butadienes synthetic latex.

The functional additive can also be an anti-chatter or anti-squawk agent. Examples of the former are the amide-metal dithiophosphate combinations such as disclosed in West German Patent 1,109,302; amine salt-azomethene combinations such as disclosed in British Patent Specification 893,977; or amine dithiophosphate such as disclosed in U.S. Pat. No. 3,002,014. Examples of anti-squawk agents are N-acyl-sarcosines and derivatives thereof such as disclosed in U.S. Pat. Nos. 3,156,652 and 3,156,653; sulfurized fatty acids and esters thereof such as disclosed in U.S. Pat. Nos. 2,913,415 and 2,982,734; and esters of dimerized fatty acids such as disclosed in U.S. Pat. No. 3,039,967. The above-cited patents are incorporated herein by reference for their disclosure to anti-chatter and anti-squawk agents.

Typically, the functional additive is present in a functionally effective amount. The term "functionally effective amount" refers to a sufficient quantity of an additive to impart desired properties intended by the addition of said additive.

The aqueous systems of this invention often contain at least one optional inhibitor for corrosion of either ferrous or non-ferrous metals or both. The inhibitor can be organic or inorganic in nature. Included are those described in "Protective Coatings for Metals" by Burns and Bradley, Reinhold Publishing Corporation, Second Edition, Chapter 13, pages 596–605, the disclosure of which relative to inhibitors are hereby incorporated by reference. Specific examples of useful inorganic inhibitors include alkali metal nitrites, sodium di- and tripolyphosphate, potassium and dipotassium phosphate, alkali metal borate and mixtures of the same. Specific examples of organic inhibitors include hydrocarbyl amine and hydroxy-substituted hydrocarbyl amine neutralized acid compounds, such as neutralized phosphates and hydrocarbyl phosphate esters, neutralized fatty acids, neutralized aromatic carboxylic acids (e.g., 4-tetiarybutyl benzoic acid), neutralized naphthenic acids and neutralized hydrocarbyl sulfonates. Particularly useful amines include the alkanolamines such as ethanolamine, diethanolamine.

The aqueous systems of the present invention can also include at least one bactericide. Such bactericides are well known to those of skill in the art and specific examples can be found in the aforementioned McCutcheon publication "Functional Materials" under the heading "Antimicrobials" on pages 9–20 thereof. This disclosure is hereby incorporated by reference as it relates to suitable bactericides for use in the aqueous compositions or systems of this invention.

The aqueous systems of the present invention can also include such other materials as dyes, e.g., an acid green dye; water softeners, e.g., ethylenediaminetetraacetate sodium salt or nitrilotriacetic acid; odor masking agents, e.g., citronella, oil of lemon; antifreeze additive, e.g., ethylene glycol and analogous polyoxyalkylene polyols; and antifoamants, such as the well-known silicone antifoamant agents.

Discussion of aqueous compositions and components of aqueous systems occurs in U.S. Pat. No. 4,707,301, herein incorporated by reference for its disclosure of aqueous compositions and components of aqueous compositions.

EXAMPLES A-1 TO A-2

The following examples relate to aqueous compositions containing the hydroxyalkyl dithiocarbamates and borates thereof. The examples are prepared by mixing the components in a homogenizer.

| | A-1 | A-2 |
|---|---|---|
| 100 neutral mineral oil | 4.0 | 4.0 |
| Water | 95.0 | 95.0 |
| Reaction product of diethylethanolamine and a polybutenyl-(Mn = 950)-substituted succinic anhydride | 0.8 | 0.8 |
| Product of Example 1 | 0.1 | — |
| Product of Example 9 | — | 0.15 |

While the invention has been explained in relation to its preferred embodiments, it is to be understood that various modifications thereof will become apparent to those skilled in the an upon reading the specification. Therefore, it is to be understood that the invention disclosed herein is intended to cover such modifications as fall within the scope of the appended claims.

We claim:

1. A lubricating composition comprising a major amount of an oil of lubricating viscosity, (A) a borate of a hydroxyalkyl dithiocarbamate, and (B) at least one sulfur compound, (C) at least one phosphorus or boron antiwear or extreme pressure agent, or mixtures thereof.

2. The composition of claim 1 wherein the hydroxyalkyl dithiocarbarmate is prepared by reacting an amine, carbon disulfide, and an epoxide.

3. The composition of claim 2 wherein the amine is a hydrocarbyl amine independently having from one to about 24 carbon atoms in each hydrocarbyl group.

4. The composition of claim 3 wherein each hydrocarbyl group independently contains from one to about 12 carbon atoms.

5. The composition of claim 2 wherein the epoxide contains from about two to about 30 carbon atoms.

6. The composition of claim 2 wherein the epoxide is ethylene oxide or propylene oxide.

7. The composition of claim 1 wherein the sulfur compound is an organic polysulfide.

8. The composition of claim 1 wherein (C) is selected from the group consisting of a metal thiophosphate, a phosphoric acid ester or a salt thereof, a phosphite, a phosphorus-containing carboxylic acid, ester, ether or amide, a borated dispersant, an alkali metal borate, a borated overbased compound, a borated fatty amine, a borated phospholipid, a borate ester, and mixtures thereof.

9. The composition of claim 1 wherein the lubricating composition is a gear oil.

10. A lubricating composition comprising a major amount of an oil of lubricating viscosity, (A) a hydroxyalkyl dithiocarbamate or a borate thereof, and (B) at least one sulfur compound, (C) at least one phosphorus or boron antiwear or extreme pressure agent or mixtures thereof.

11. The composition of claim 10 wherein the hydroxyalkyl dithiocarbamate is prepared by reacting an amine, carbon disulfide, and an epoxide.

12. The composition of claim 11 wherein the amine is hydrocarbyl amine independently having from one to about 40 carbon atoms in each hydrocarbyl group.

13. The composition of claim 11 wherein the amine is an acylated amine containing at least one NH group, wherein the acylated amine is prepared by reacting a carboxylic acylating agent and an amine.

14. The composition of claim 13 wherein the carboxylic acylating agent is a hydrocarbyl substituted carboxylic acylating agent.

15. The composition of claim 13 wherein the hydrocarbyl group contains from eight to about 200 carbon atoms.

16. The composition of claim 13 wherein the hydrocarbyl group contains from eight to about 30 carbon atoms.

17. The composition of claim 13 wherein the hydrocarbyl group is derived from a polyalkene having a number average molecular weight from about 500 up to about 5000.

18. The composition of claim 13 wherein the carboxylic acylating agent is a succinic acylating agent.

19. The composition of claim 10 wherein the sulfur compound is an organic polysulfide.

20. The composition of claim 10 wherein the lubricating composition comprises both (B) and (C).

21. The composition of claim 1 wherein the lubricating composition is a metal working fluid, or a hydraulic fluid.

22. An aqueous functional fluid comprising water, a surfactant or thickener, and at least one hydroxyalkyl dithiocarbamate or at least one borate thereof.

23. The composition of claim 22 wherein the aqueous functional fluid is a hydraulic fluid, or a metal working fluid.

24. The composition of claim 10 wherein (C) is selected from the group consisting of a metal thiophosphate, a phosphoric acid ester or a salt thereof, a phosphite, a phosphorus-containing carboxylic acid, ester, ether or amide, a borated dispersant, an alkali metal borate, a borated overbased compound, a borated fatty amine, a borated phospholipid, a borate ester, and mixtures thereof.

25. The composition of claim 10 wherein (C) is selected from the group consisting a phosphorus acid ester, prepared by reacting one or more phosphorus acids or anhydrides with an alcohol containing from 1 to 30 carbon atoms, or salts of the phosphorus acid ester, a phosphite, the reaction product of a phosphorus containing acid and an unsaturated amide, an unsaturated carboxylic ester, and a vinyl ether, and mixtures thereof.

26. The composition of claim 10, wherein (C) is selected from the group consisting of a phosphoric acid ester, or salt thereof, a thiophosphorous acid ester, or salt thereof, a phosphite and mixtures thereof.

27. The composition of claim 10 wherein (C) is a phosphorus acid ester prepared by reacting a dithiophosphorus acid with an epoxide or a polyhydric alcohol to form an intermediate and further reacting the intermediate with a phosphorus acid, anhydride or lower ester.

28. The composition of claim 10 wherein (C) is a borated overbased compound, a borated dispersant, or mixtures thereof.

29. The lubricating composition of claim 10 wherein (A) is present in an amount from about 0.01% to about 10% by weight, (B) is present in an amount from about 0.05% to about 10% by weight, and (C) is present in an amount from about 0.01% to about 10% by weight.

30. A gear oil composition comprising a major amount of a gear oil base stock, and (A) an antiwear or extreme pressure amount of at least one hydroxyalkyl dithiocarbamate or at least one borate thereof, wherein the dithiocarbamate is derived from an amine other than an alkyl or alkenylsuccinimide and (B) at least one sulfur compound, (C) at least one phosphorus or boron antiwear or extreme pressure agent, or mixtures thereof.

31. The composition of claim 30 wherein (B) is an organic polysulfide.

32. The composition of claim 30 wherein (C) is selected from the group consisting of a metal thiophosphate, a phosphoric acid ester or a salt thereof, a phosphite, a phosphorus-containing carboxylic acid, ester, ether or amide, a borated dispersant, an alkali metal borate, a borated overbased compound, a borated fatty amine, a borated phospholipid, a borate ester, and mixtures thereof.

* * * * *